US010556319B2

(12) United States Patent
Iwakami et al.

(10) Patent No.: US 10,556,319 B2
(45) Date of Patent: Feb. 11, 2020

(54) GRINDER AND COVER

(71) Applicant: MAKITA CORPORATION, Anjo-Shi (JP)

(72) Inventors: Junichi Iwakami, Anjo (JP); Hideharu Muto, Anjo (JP); Naoki Soeda, Anjo (JP); Ryosuke Otani, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 474 days.

(21) Appl. No.: 15/258,098

(22) Filed: Sep. 7, 2016

(65) Prior Publication Data

US 2017/0072535 A1 Mar. 16, 2017

(30) Foreign Application Priority Data

Sep. 10, 2015 (JP) ..... 2015-178870

(51) Int. Cl.
*B24B 55/05* (2006.01)
*B24B 23/02* (2006.01)

(52) U.S. Cl.
CPC ..... *B24B 55/052* (2013.01); *B24B 23/028* (2013.01)

(58) Field of Classification Search
CPC ..... B24B 23/02; B24B 23/028; B24B 55/05; B24B 55/052; B24B 55/055; B27G 19/02; B27G 19/04
USPC ..... 451/358, 359; 83/478; 30/390, 391
See application file for complete search history.

(56) References Cited

U.S. PATENT DOCUMENTS

| | | | | |
|---|---|---|---|---|
| 3,793,784 | A | 2/1974 | Jetzt | |
| 4,622,782 | A | 11/1986 | Roestenberg | |
| 5,766,062 | A | 6/1998 | Edling | |
| 5,974,674 | A * | 11/1999 | Kelly | B27B 5/08 144/136.95 |
| 6,699,114 | B1 | 3/2004 | Booeshaghi et al. | |
| 7,310,879 | B1 * | 12/2007 | Clarke | B23D 45/16 30/122 |
| 2006/0068690 | A1 | 3/2006 | Koschel et al. | |

(Continued)

FOREIGN PATENT DOCUMENTS

| | | | |
|---|---|---|---|
| CN | 103372813 | A | 10/2013 |
| DE | 29717099 | U1 | 12/1997 |

(Continued)

OTHER PUBLICATIONS

U.S. Appl. No. 15/257,987, filed Sep. 7, 2016.

(Continued)

*Primary Examiner* — Timothy V Eley
*Assistant Examiner* — Marcel T Dion
(74) *Attorney, Agent, or Firm* — J-Tek Law PLLC; Jeffrey D. Tekanic; Scott T. Wakeman

(57) ABSTRACT

A grinder includes a motor, a housing, a spindle and a cover. The spindle protrudes downward from the housing, is driven by the motor, and thereby rotates. The cover at least partially covers a tool accessory mounted on the spindle. The cover includes a first cover part and a second cover part. The first cover part is fixed to the housing and at least partially covers the tool accessory from above. The second cover part is held such that it is capable of moving relative to the first cover part. The grinder is configured such that the area of the tool accessory covered by the cover changes in accordance with the relative movement.

21 Claims, 29 Drawing Sheets

(56) References Cited

U.S. PATENT DOCUMENTS

| | | | | |
|---|---|---|---|---|
| 2008/0022537 | A1* | 1/2008 | Clarke | B23D 45/16 30/390 |
| 2008/0264225 | A1* | 10/2008 | Crain | B23D 59/006 83/478 |
| 2009/0029635 | A1 | 1/2009 | Boeck et al. | |
| 2009/0061749 | A1* | 3/2009 | Sunderland | B24B 9/06 451/438 |
| 2009/0197515 | A1 | 8/2009 | Wang | |
| 2009/0229436 | A1* | 9/2009 | Crain | B27B 5/08 83/373 |
| 2010/0210195 | A1 | 8/2010 | Numata et al. | |
| 2010/0261417 | A1 | 10/2010 | O'Shannessy | |
| 2010/0304648 | A1 | 12/2010 | Boeck et al. | |
| 2011/0092141 | A1 | 4/2011 | McCutchen et al. | |
| 2011/0275293 | A1* | 11/2011 | Eto | B24B 23/028 451/453 |
| 2011/0318999 | A1 | 12/2011 | Boeck et al. | |
| 2012/0190280 | A1 | 7/2012 | Esenwein | |
| 2013/0157550 | A1 | 6/2013 | Ikuta | |
| 2014/0302758 | A1* | 10/2014 | Moncrieff | B26B 29/00 451/451 |
| 2014/0329447 | A1* | 11/2014 | Copeland | B24B 23/028 451/451 |
| 2014/0342645 | A1 | 11/2014 | Tagscherer | |
| 2015/0246423 | A1* | 9/2015 | Lupsac | B24B 9/06 451/359 |
| 2015/0314413 | A1* | 11/2015 | Roeck | B24B 23/02 451/344 |
| 2017/0072532 | A1 | 3/2017 | Kawakami et al. | |
| 2017/0072533 | A1 | 3/2017 | Yoshizaki et al. | |
| 2017/0072534 | A1 | 3/2017 | Nakamura et al. | |

FOREIGN PATENT DOCUMENTS

| | | | | | |
|---|---|---|---|---|---|
| DE | 10107290 | A1 | | 9/2002 | |
| DE | 102007041840 | A1 | | 5/2008 | |
| DE | 102007046311 | A1 | | 4/2009 | |
| DE | 102008022294 | A1 | | 10/2009 | |
| DE | 102009028404 | A1 | | 2/2011 | |
| DE | 102012207571 | A1 | | 10/2013 | |
| EP | 0267993 | A1 | | 5/1988 | |
| EP | 0812657 | A1 | | 12/1997 | |
| EP | 1642680 | A1 | | 4/2006 | |
| EP | 1952944 | A1 | | 8/2008 | |
| EP | 2205397 | B1 | | 3/2012 | |
| GB | 940226 | A | | 10/1963 | |
| GB | 2329440 | A | | 3/1999 | |
| GB | 2441638 | A | * | 3/2008 | B24B 23/02 |
| JP | S5813952 | U | | 1/1983 | |
| JP | H02122755 | U | | 10/1990 | |
| JP | 2009000795 | A | | 1/2009 | |
| JP | 2010162680 | A | | 7/2010 | |
| JP | 2013078823 | A | | 5/2013 | |
| JP | 2013208677 | A | | 10/2013 | |
| JP | 2013226617 | A | | 11/2013 | |
| WO | 2013161444 | A1 | | 10/2013 | |

OTHER PUBLICATIONS

U.S. Appl. No. 15/258,010, filed Sep. 7, 2016.

U.S. Appl. No. 15/258,045, filed Sep. 7, 2016.

Office Action from the United States Patent Office dated Apr. 17, 2018 in related U.S. Appl. No. 15/258,010, including examined claims 1-19.

Office Action from the United States Patent Office dated Apr. 18, 2018 in related U.S. Appl. No. 15/257,987, including examined claims 1-19.

Extended European Search Report from the European Patent Office dated Feb. 20, 2017 in related EP application No. 16 187 688.3, including European Search Opinion, European Search Report, and examined claims 1-12.

Extended European Search Report from the European Patent Office dated Feb. 20, 2017 in related EP application No. 16 187 679.2, including European Search Opinion, European Search Report, and examined claims 1-15.

Extended European Search Report from the European Patent Office dated Feb. 21, 2017 in related EP application No. 16187692.5 including European Search Opinion, European Search Report, and examined claims 1-14.

Extended European Search Report from the European Patent Office dated Jan. 31, 2017 in related EP application No. 16 187 675.0, including European Search Opinion, European Search Report, and examined claims 1-9.

Machine translation of Search Report from the Japanese Patent Office dated Mar. 22, 2019 in counterpart Japanese application No. 2015-178870.

Office Action from the Japanese Patent Office dated Mar. 26, 2019 in counterpart Japanese application No. 2015-178870, and translation thereof.

* cited by examiner

GRINDER AND COVER

CROSS-REFERENCE

This application claims priority to Japanese patent application serial number 2015-178870, filed on Sep. 10, 2015, the contents of which are incorporated herein by reference in their entirety.

TECHNICAL FIELD

The present disclosure relates to a grinder.

BACKGROUND ART

A grinder is known that is capable of performing processing, such as grinding, polishing, cutting, or the like, on a workpiece. The grinder comprises a spindle that is rotationally driven by a drive device. Various tool accessories are detachably mountable on the spindle. A protective cover that covers the tool accessory from above is normally mounted on the grinder (e.g., refer to Japanese Laid-open Patent Publication No. 2013-78823).

SUMMARY

If the surface area over which the protective cover covers the tool accessory is increased in order to reduce the dispersion of dust, then the protective cover interferes with the workpiece and with the use of the grinder, thereby reducing work efficiency and grinder processing performance.

Consequently, conventionally, a protective cover is prepared for each type of tool accessory. A specialized protective cover for each type of tool accessory makes it possible, owing to the cover's shape being made suited to the processing work, to achieve high work efficiency and high processing performance while reducing the dispersion of dust.

Nevertheless, exchanging the protective cover, in addition to exchanging the tool accessory, is extremely labor intensive for users. Consequently, conventionally, there have been many users who, without exchanging the protective cover, exchange only the tool accessory and then perform work.

Accordingly, in one aspect of the present teachings, a grinder and a cover can be provided that are highly convenient while having the ability to reduce the dispersion of dust.

A grinder according to one aspect of the present disclosure comprises a motor, a housing, a spindle, and a cover. The housing houses the motor. The spindle protrudes downward from the housing, is driven by the motor, and thereby rotates. The cover at least partially covers the tool accessory mounted on the spindle.

According to another aspect of the present disclosure, the cover comprises a first cover part and a second cover part, wherein the second cover part is held such that it is capable of moving with respect to the first cover part. The first cover part can be fixed to the housing. The first cover part can be configured such that it is provided in a circumferential direction of the spindle and at least partially covers the tool accessory from above.

According to another aspect of the present disclosure, the second cover part can be held by the first cover part such that the second cover part is capable of relative movement with respect to the first cover part. The cover can be configured such that an area of the tool accessory covered by the cover changes in accordance with the relative movement of the second cover part with respect to the first cover part. The area of the tool accessory covered by the cover corresponds to the area, within the range (circumference) of the tool accessory, that is covered by the cover.

According to the grinder that comprises such a cover, the area of the tool accessory covered by the cover can be adjusted. The adjustment can be performed, for example, to prevent interference between the tool accessory and the workpiece during processing work or to prevent interference between the tool accessory and the cover when exchanging the tool accessory. Accordingly, in this aspect of the present disclosure, it is possible to provide a highly convenient grinder, even if multiple types of the tool accessory are used.

According to another aspect of the present disclosure, a second cover part can be held by the first cover part such that the second cover part is capable of relative movement along a circumferential direction of the spindle. The cover can be configured such that an area of the tool accessory covered by the cover changes in accordance with the relative movement of the second cover part along the circumferential direction with respect to the first cover part.

According to another aspect of the present disclosure, the first cover part may be configured such that, in a specific angular area in the circumferential direction, the tool accessory is partially covered from below. This angular area corresponds to the area of the cover part when a range of angles along the circumferential direction has been specified. In this case, the second cover part can be configured such that it undergoes relative movement with respect to the first cover part along the circumferential direction from the specific angular area to a separate angular area in which the tool accessory is not covered from below by the first cover part, and thereby the area below the tool accessory that is not covered by the first cover part is at least partially covered.

As is well known, the portion of the tool accessory that is proximate to the workpiece during processing work differs according to the type of the tool accessory and the processing method. In one operation, the lower surface of the tool accessory is used; in another operation, the side edge of the tool accessory is used. Accordingly, in a grinder, in which the surface area below the tool accessory covered by the protective cover is adjustable, high work efficiency is exhibited for the multiplicity of operations described above. That is, high work efficiency can be achieved even if the tool accessory is modified in accordance with the work application.

According to another aspect of the present disclosure, the cover may comprise: a first cover part that is provided in a circumferential direction of the spindle, is fixed to the housing, and at least partially covers the tool accessory from above; and a second cover part that is held by the first cover part such that the second cover part is capable of pivoting around a specific axis that is nonparallel to an axial direction of the spindle. The cover can be configured such that an area of the tool accessory covered by the cover changes in accordance with the pivoting of the second cover part around the specific axis with respect to the first cover part.

According to another aspect of the present disclosure, the second cover part may be held by the first cover part such that the second cover part is capable of pivoting around a prescribed axis along a plane that is perpendicular to the axial direction of the spindle. The second cover part can be configured such that it is disposed at differing first and second positions, owing to the pivoting, with respect to the first cover part, wherein, at the first position, the area below the tool accessory not covered by the first cover part is at least partially covered, and, at the second position, the area above the tool accessory not covered by the first cover part is at least partially covered. According to the grinder that comprises such a cover, it is likewise possible to achieve high work efficiency for a multiplicity of operations with differing types of the tool accessory and differing processing methods.

The second cover part may be configured such that the user's view is at least partially not blocked. For example, the second cover part may be at least partially composed of a transparent material or a mesh material.

Providing the cover with the second cover part in addition to the first cover part contributes to reducing the amount of dust flying about. Nevertheless, during processing work, there is a possibility that, depending on the particular application, the second cover part will be interposed between the portion of the workpiece to be processed and the user's eyes. If the second cover part is configured such that it does not at least partially block the user's view, then it is possible to prevent the second cover part from having an undesirable effect on work efficiency.

In another aspect of the present disclosure, a grinder may be configured such that the cover comprises: a first cover part that is provided in a circumferential direction of the spindle, is fixed to the housing, and at least partially covers the tool accessory from above; and a second cover part that is held by the first cover part such that the second cover part is capable of relative movement along an axial direction of the spindle with respect to the first cover part. The cover can be configured such that an area of the tool accessory covered by the cover changes in accordance with change in the position of the second cover part with respect to the first cover part owing to the relative movement along the axial direction.

According to another aspect of the present disclosure, the second cover part can be configured such that it is disposed, owing to the relative movement along the axial direction, at differing first and second positions with respect to the first cover part, wherein, at the first position, the second cover part forms a space, which houses the tool accessory between the second cover part and the inner surface of the first cover part that faces the tool accessory, and at least partially covers the tool accessory from below, and, at the second position, the second cover part approaches the inner surface of the first cover part and, together with the first cover part, at least partially covers the tool accessory from above.

In another aspect of the present disclosure, the cover may be configured such that it comprises: a first cover part that is provided in a circumferential direction of the spindle, is fixed to the housing, has a surface that at least partially covers the tool accessory from above, and extends along the surface; and a second cover part that is held by the first cover part such that the second cover part is capable of relative movement along the surface with respect to the first cover part. The cover can be configured such that an area of the tool accessory covered by the cover changes in accordance with the relative movement of the second cover part along the surface with respect to the first cover part.

In this cover, the second cover part may be configured such that it at least partially covers the tool accessory from below; and the cover can be configured such that an area below the tool accessory covered by the cover changes in accordance with the relative movement of the second cover part with respect to the first cover part along the surface.

In another aspect of the present disclosure, the cover may be configured such that it comprises: a first cover part that is provided in a circumferential direction of the spindle, is fixed to the housing, and at least partially covers the tool accessory from above; and a second cover part that is held by the first cover part and has a foldable structure. The cover can be configured such that an area of the tool accessory covered by the cover changes in accordance with whether the second cover part is in the folded state.

In this cover, the second cover part can be configured such that, in the folded state, the second cover part covers a first area below the tool accessory that is not covered by the first cover part and, in the unfolded state, the second cover part covers, in addition to the first area, a second area below the tool accessory that is not covered by the first cover part.

In addition, according to another aspect of the present disclosure, the cover described above, which is mounted on the grinder, may be provided. According to another aspect of the present disclosure, a cover that at least partially covers a tool accessory mounted on a spindle, which constitutes a grinder and protrudes downward from a housing, may be provided, wherein the cover comprises first and second parts, which have at least one of the features discussed above.

According to another aspect of the present disclosure, a method of using a grinder may be provided, comprising the steps of: attaching a cover, the cover being designed to at least partially cover a tool accessory around a circumference of a spindle that constitutes the grinder and protrudes downward from a housing, to the housing, wherein the cover comprises a movable part and changes shape such that an area of the tool accessory covered by the cover changes in accordance with an operation of the movable part; and if a grinding wheel for grinding serves as the tool accessory and is to be attached to the spindle, then operating the movable part to set the cover to a first shape, and, if a grinding wheel for cutting serves as the tool accessory and is to be attached to the spindle, then operating the movable part to set the cover to a second shape; wherein, the cover covers an area below the tool accessory that is larger for the second shape than for the first shape.

DETAILED DESCRIPTION OF EMBODIMENTS

Illustrative embodiments of the present disclosure are explained below, with reference to the drawings.

Basic Configuration

First, the internal configuration of a basic grinder 1 will be explained. The grinder 1 is a so-called disc grinder to which a discoidal (disc-shaped) tool accessory (tip tool) 40 is attached. The grinder 1 performs processing on a workpiece by rotating the tool accessory 40. The tool accessory 40 may comprise any of a variety of grinding wheels, such as a cutting stone, a grinding stone, or the like, and further may comprise a wire brush. The grinder 1 is configured such that the tool accessory 40 is exchangeable.

Figure 1:
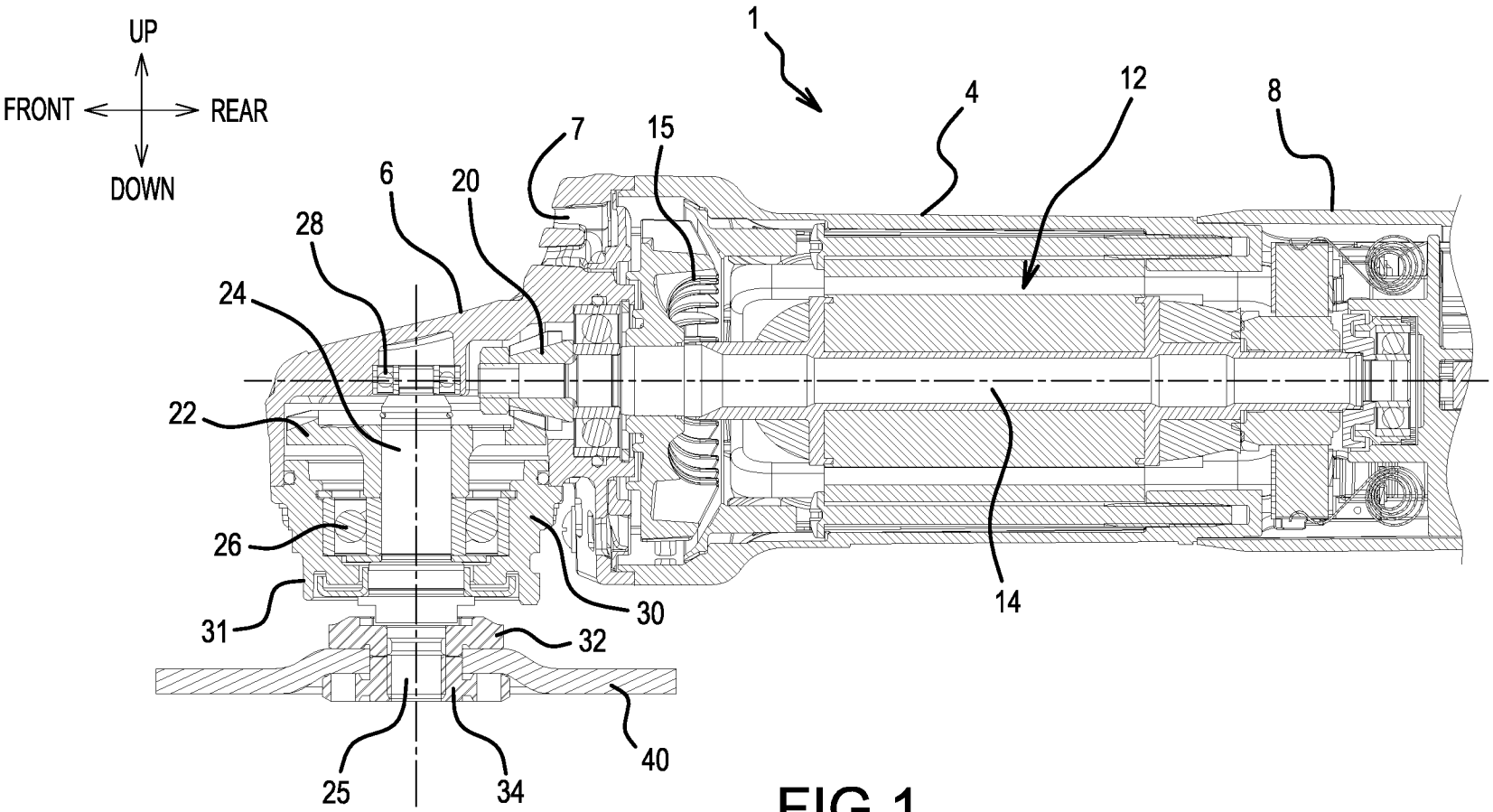
FIG. 1 is a cross-sectional view that shows the internal configuration of a grinder.

Grinders 100, 200, 300, 400, 500 according to a first embodiment to a fifth embodiment, which are explained following the explanation of the grinder 1, are each configured such that, in each embodiment, a characteristic protective cover is attached to the grinder 1 shown in FIG. 1 or to a similar grinder.

In the plurality of these embodiments, a front-rear direction is defined along an axis line of an elongate grinder main body or along a corresponding rotary shaft 14 of a motor 12. Specifically, the side on which a spindle 24 is provided on the grinder main body is defined as the "front" and the opposite side is defined as the "rear."

In addition, an up-down direction is defined based on an axis line of the spindle 24. Specifically, the side on which the spindle 24 is housed in a first gear housing 6 and a second gear housing 30 is defined as "up," and the side on which the tool accessory 40 is mounted on the spindle 24 is defined as "down." In addition, a surface that extends in the up-down direction is defined as a "side surface" and thus utilizes a term related to direction.

The grinder 1 shown in FIG. 1 comprises a motor housing 4, the first gear housing 6, and a rear cover 8. The grinder 1 further comprises the second gear housing 30. The internal elements that constitute the grinder 1 are housed in an internal space of the grinder main body, which is principally formed by the motor housing 4, the first gear housing 6, the second gear housing 30, and the rear cover 8.

Figure 3:
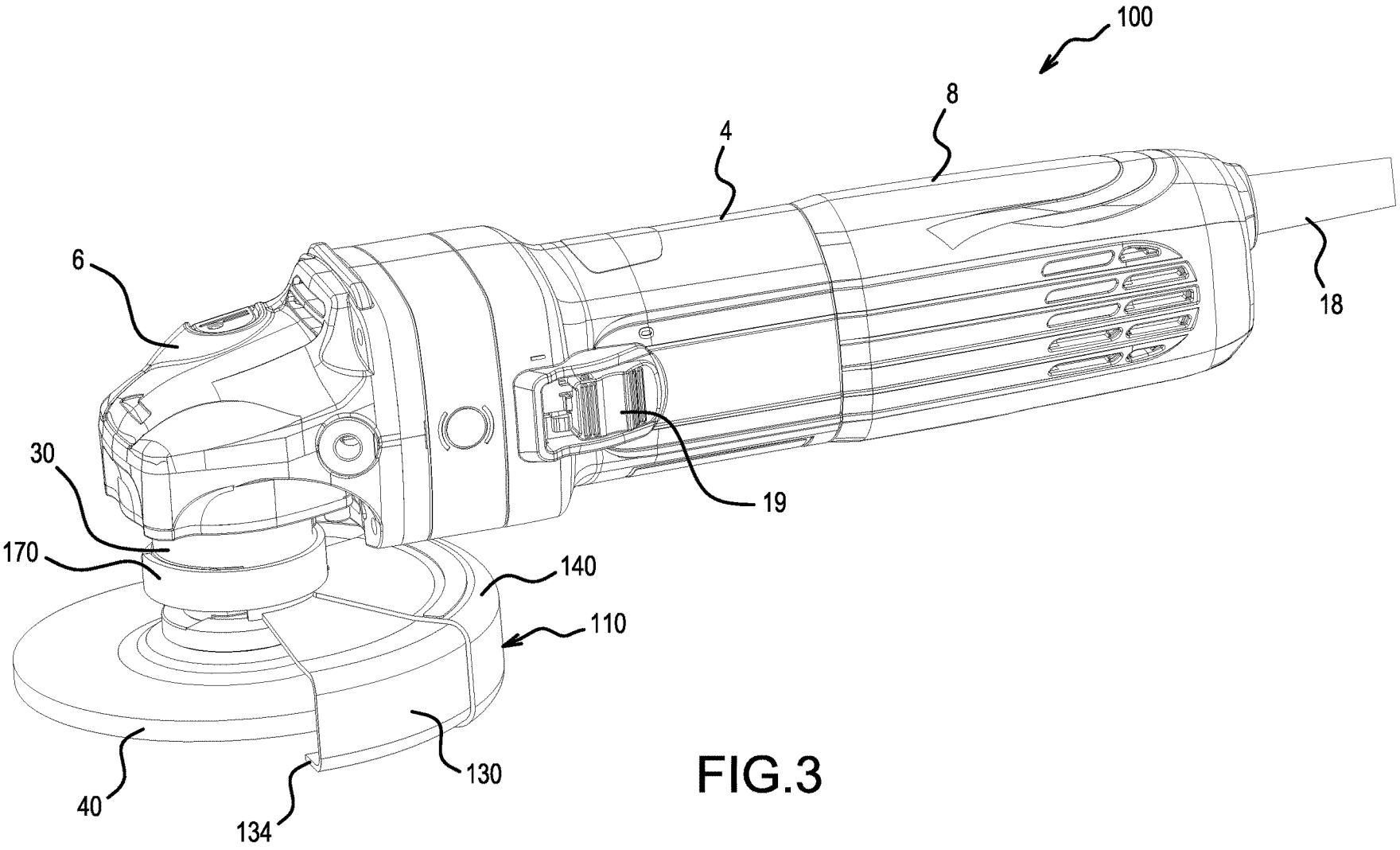
FIG. 3 is an oblique view that shows a first aspect of the grinder according to a first embodiment.

The motor housing 4 is a substantially circular-cylindrical housing and houses the motor 12. The rotary shaft 14 of the motor 12 is disposed such that it protrudes toward the first gear housing 6, which is adjacent to the motor housing 4. The rear cover 8 is provided rearward of the motor housing 4 and houses circuitry for supplying drive current to the motor 12, thereby driving the motor 12. The circuitry is supplied with external electric power via a power-supply cord 18 (refer to FIG. 3, etc.), which is not shown in FIG. 1. The drive of the grinder 1 is turned ON and OFF by a user operating a switch-operation unit 19 (not shown in FIG. 1) that is provided such that it is externally exposed.

The first gear housing 6 is provided forward of the motor housing 4 and houses a first bevel gear 20, a second bevel gear 22, the spindle 24, and bearings 26, 28.

The first bevel gear 20 is fixed to a rotary shaft of the motor 12 inside the first gear housing 6. The second bevel gear 22 and the spindle 24 are rotatably provided in the second gear housing 30, which is configured as a structure separate from the first gear housing 6, via the bearing 26. The second bevel gear 22 and an upper part of the spindle 24 are housed inside the first gear housing 6 by virtue of the second gear housing 30 being fixed to the first gear housing 6.

The second gear housing 30 is fixed to the first gear housing 6 such that the spindle 24 is orthogonal to the rotary shaft 14 of the motor 12. The second gear housing 30 is, for example, screw-fastened to the first gear housing 6.

The second bevel gear 22 is fixed to the spindle 24. The second bevel gear 22 meshes with the first bevel gear 20 inside the first gear housing 6, and the rotational output of the motor 12 is thereby converted into a rotational force around the axis of the spindle 24.

One end of the spindle 24 is rotatably supported by the first gear housing 6 via the bearing 28, and the other end of the spindle 24 protrudes downward from the second gear housing 30.

An inner flange 32 for positioning and fixing the discoidal tool accessory 40 is provided on the portion of the spindle 24 that protrudes from the second gear housing 30. A screw part 25, onto which a lock nut 34 is screwed, is formed on an outer-circumferential portion of the spindle 24 that is closer to the tip than is the inner flange 32. The lock nut 34 is fixed to a lower end of the spindle 24 by screw-fastening, and the tool accessory 40 is sandwiched and fixed between the lock nut 34 and the inner flange 32.

In the grinder 1 configured in this manner, when the user turns the grinder 1 ON using the switch-operation unit 19, the motor 12 rotates and the rotational output thereof is transmitted to the spindle 24 via a gear mechanism (the bevel gears 20, 22) inside the first gear housing 6. That is, the spindle 24 is rotationally driven by a drive device that includes the motor 12 and the gear mechanism and is housed in the housings 4, 6, 30.

Consequently, when the tool accessory 40 is fixed to the spindle 24 using the lock nut 34, the tool accessory 40 rotates in accordance with the rotation of the spindle 24. The grinder 1 performs processing, such as grinding, polishing, cutting, or the like, on the workpiece by the rotation of the tool accessory 40. However, the potential processing depends on the type of the tool accessory 40 mounted on the spindle 24.

A fan 15, which draws in outside air from an inlet hole of the rear cover 8 and exhausts air via an exhaust hole 7 provided in the first gear housing 6, is provided on the rotary shaft 14 of the motor 12.

Figure 2:
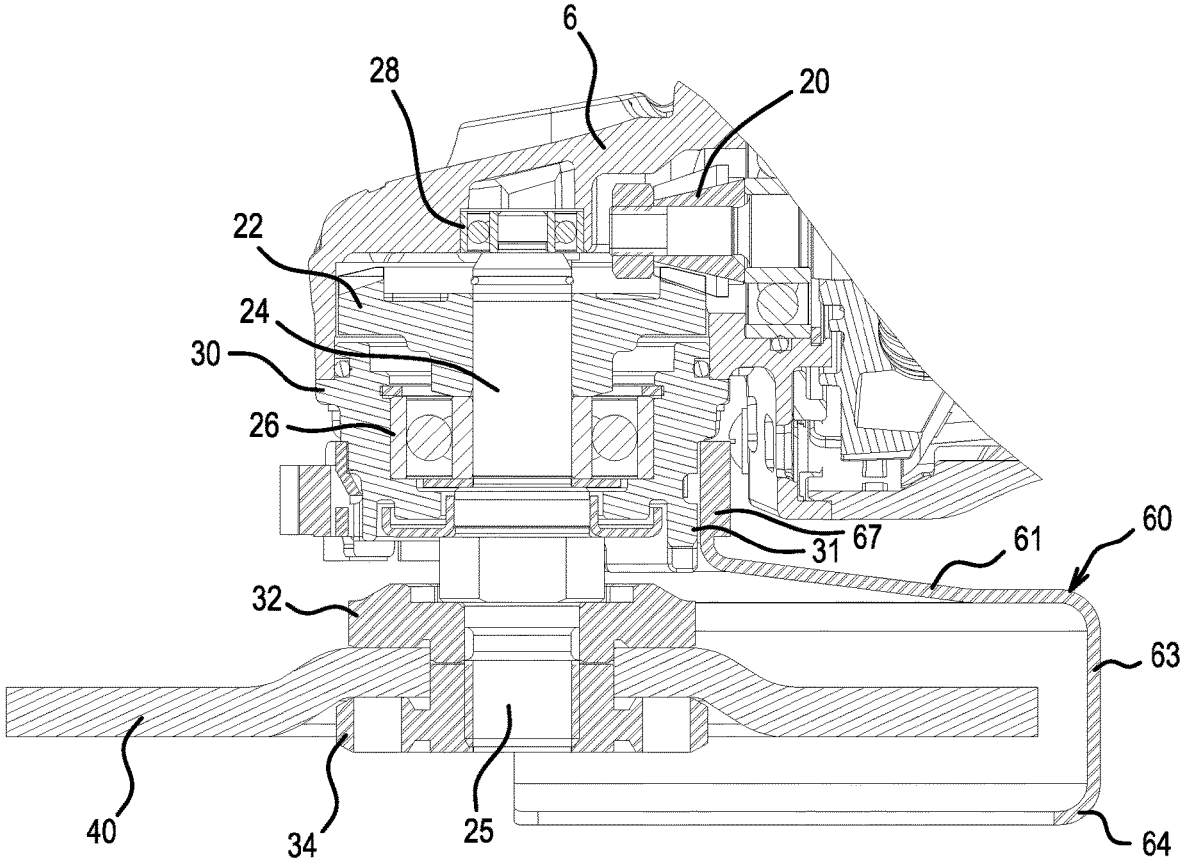
FIG. 2 is a cross-sectional view that shows the configuration surrounding a spindle of the grinder of FIG. 1 when a conventional protective cover is mounted on the grinder.

A protective cover 60, which covers the discoidal tool accessory 40, is further provided on the grinder 1 (refer to FIG. 2). The protective cover 60 is also called a wheel cover or a disc cover in the relevant technical field. The phrase "to cover" in the present specification means to at least partially cover an object and, unless otherwise specially mentioned, is not limited to covering the entirety of the object.

FIG. 2 shows a cross-sectional configuration of the periphery of the spindle 24 and the tool accessory 40 with the conventional protective cover 60 mounted on the grinder 1 shown in FIG. 1.

The protective cover 60 shown in FIG. 2 comprises: a semicircular upper-part structure 61 for covering a rearward semicircular portion of an upper part of the discoidal tool accessory 40; and a side-part structure 63, which extends downward from an outer-circumferential-end edge of the upper-part structure 61. The protective cover 60 is configured by integrally forming the upper-part structure 61 and the side-part structure 63. For example, the upper-part structure 61 and the side-part structure 63 are integrally formed of a metal material. A curved part 64 is provided at the lower end of the side-part structure 63, and thereby the side-part structure 63 is slightly curved at the lower end toward the inner side in the radial direction.

The protective cover 60 further comprises a circular-tubular part 67 for fixing the protective cover 60 to the second gear housing 30. The circular-tubular part 67 is provided on the upper-part structure 61 and serves as a circular-tubular part that is concentric with an outer-circumferential arc of the upper-part structure 61. The circular-tubular part 67 is designed such that its inner diameter is slightly larger than the outer diameter of a cover-connection part 31, which is provided on the second gear housing 30 and has a circular side surface.

Figure 4:
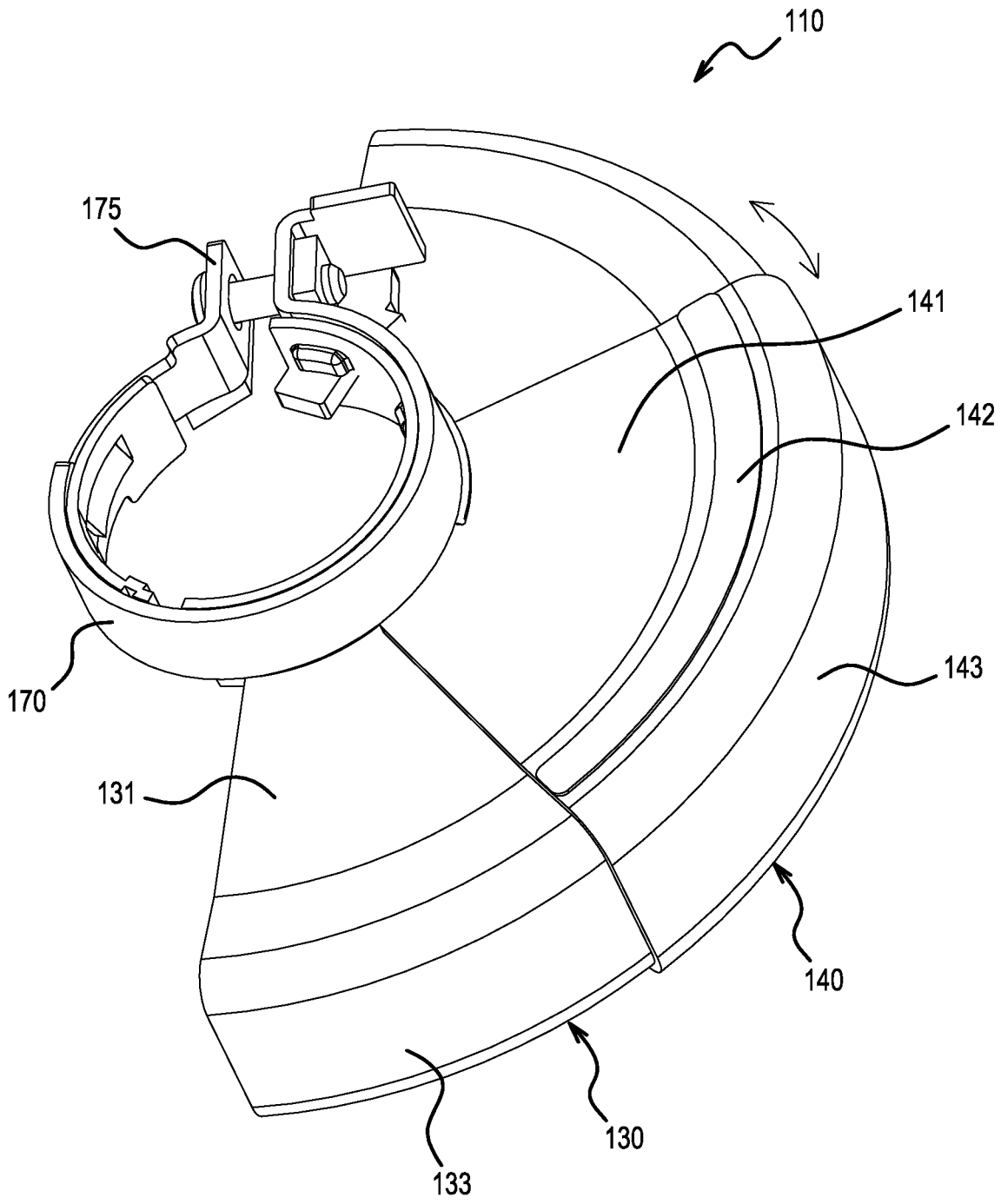
FIG. 4 is an oblique view that shows the first aspect of the protective cover according to the first embodiment.

Although not shown in FIG. 2, the circular-tubular part 67 is configured such that a section along a plane perpendicular to the up-down direction describes an open-ring shape, and the portion of the circular-tubular part 67 that is open in the circumferential direction is provided with a tightening part for tightening the circular-tubular part 67 to the cover-connection part 31 of the second gear housing 30 on the inner side in the radial direction. A circular-tubular part 170 and a tightening part 175, which have equivalent configurations, are shown in FIG. 4.

The tightening part functions such that, by changing the positional relationship between a screw and a nut, which sandwich the tightening part from both sides, an inner side of the circular-tubular part 67 is tightened onto the cover-connection part 31 of the second gear housing 30, and thereby the protective cover 60 is fixed to the second gear housing 30. The protective cover 60 shown in FIG. 2 is used when processing the workpiece by using, for example, a grinding stone.

In addition, the protective cover 60 can be attached to the cover-connection part 31 at an arbitrary angle (orientation) in the circumferential direction. The arrangement shown in FIG. 2 is a common arrangement used in grinding. The protective covers described in each embodiment below likewise can be attached to the grinder at an arbitrary angle. Accordingly, when explaining front, rear, left, and right in relation to the structural elements of the protective cover, the explanations are merely of the directions based on the common arrangement when performing grinding, and it should be understood that the orientation of the circumferential direction of the protective cover with respect to the grinder is not limited to any specific direction.

First Embodiment

The grinder 100 according to a first embodiment is configured such that a protective cover 110 shown in FIG. 3 to FIG. 9 is mounted on the grinder 1 shown in FIG. 1 or on a similar grinder.

The protective cover 110 comprises a main-cover part 130, an outer-side-cover part 140, an inner-side-cover part 150, and a circular-tubular part 170, which is for fixing the main-cover part 130 to the second gear housing 30. The protective cover 110 is configured such that the area over which the tool accessory 40 is covered from below changes by the relative movement of the outer-side-cover part 140 and the inner-side-cover part 150 with respect to the main-cover part 130.

The outer-side-cover part 140 is held by the main-cover part 130 such that the outer-side-cover part 140 is capable of moving in the circumferential direction (the rotational direction or the outer-circumferential direction of the spindle 24) along an outer surface of the main-cover part 130. The inner-side-cover part 150, which is shown in FIG. 6, FIG. 8, and FIG. 9, is held by the main-cover part 130 such that the inner-side-cover part 150 is capable of moving in the circumferential direction along an inner surface of the main-cover part 130.

Similar to the protective cover 60 described above, the main-cover part 130 comprises a semicircular upper-part structure 131, which is for covering the rearward semicircular portion of the upper part of the tool accessory 40, and a side-part structure 133, which extends downward from an outer-circumferential-end edge of the upper-part structure 131, and is configured such that the main-cover part 130 extends in the circumferential direction of the spindle 24 and covers the tool accessory 40 from above and the side. The side-part structure 133 comprises, at its lower end, a curved part 134 that curves toward the inner side in the radial direction, as shown in FIG. 5.

Figure 6:
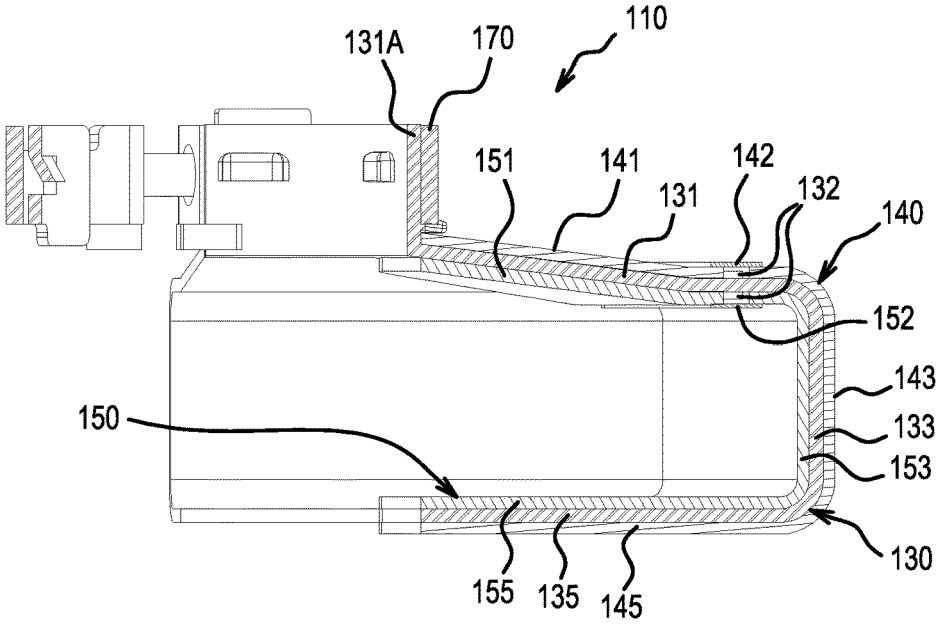
FIG. 6 is a cross-sectional view of the protective cover according to the first embodiment.
Figure 8:
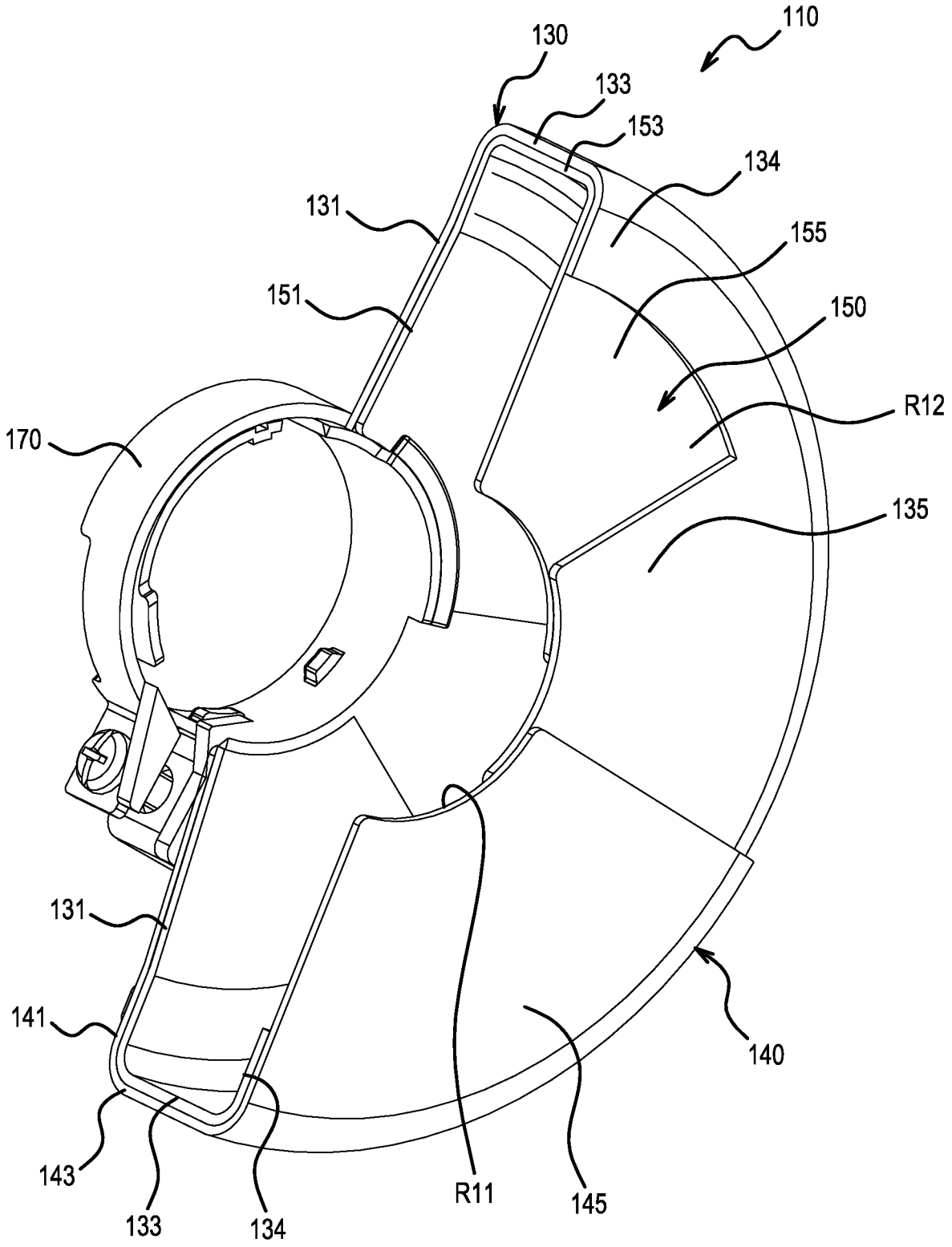
FIG. 8 is an oblique view, viewed from below, that shows the second aspect of the protective cover according to the first embodiment.
Figure 9:
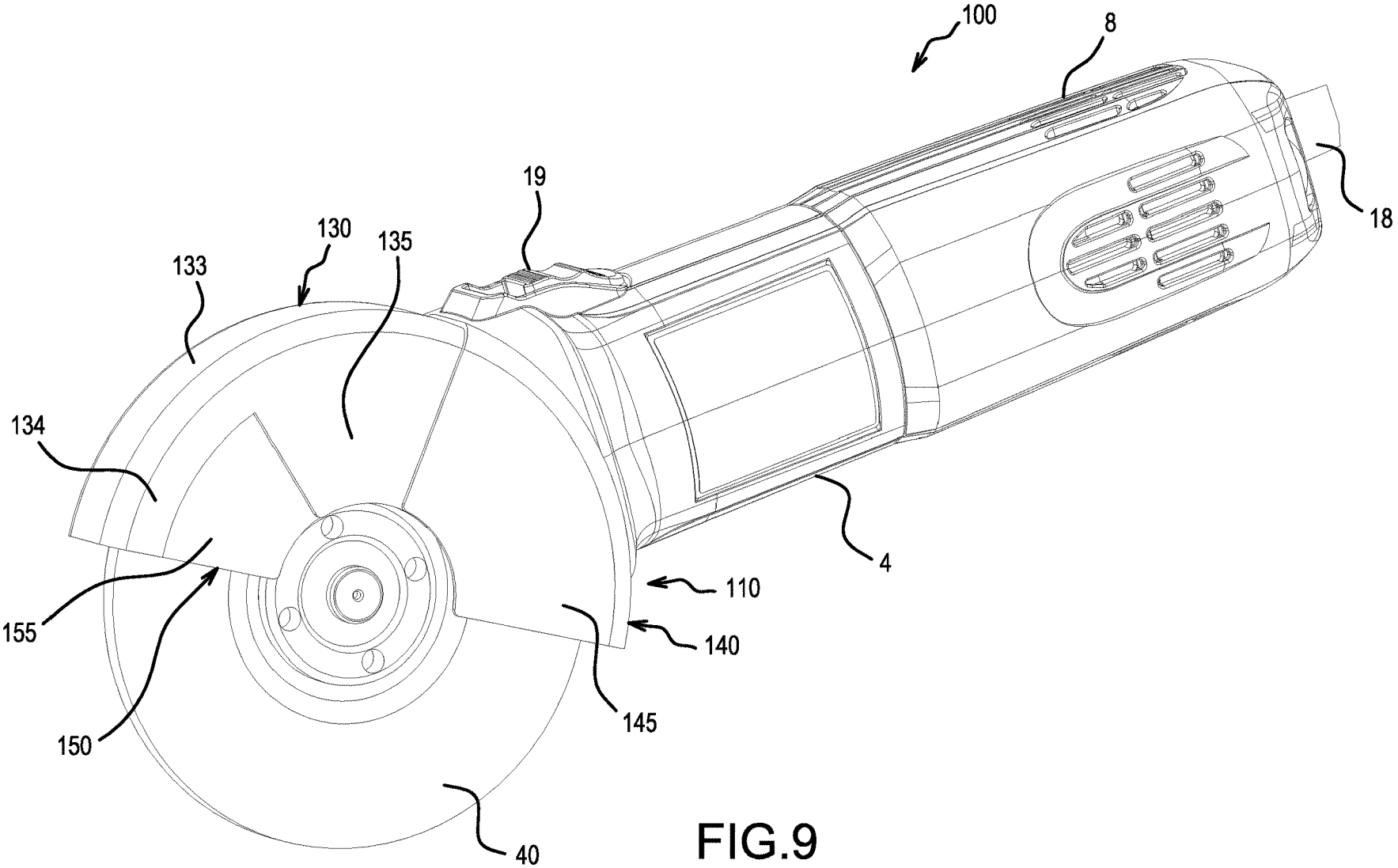
FIG. 9 is an oblique view that shows the second aspect of the grinder according to the first embodiment.

As shown in FIG. 6, FIG. 8, and FIG. 9, the main-cover part 130 further comprises a lower-part structure 135, which covers the tool accessory 40 from below, that occupies a 40°-140° angular area within the 0°-180° semicircular angular area corresponding to the upper-part structure 131. Herein, an angle indicates an angle in the circumferential direction centered on the axis line of the spindle 24, and an angular area corresponds to an area in the circumferential direction specified by a range of angles.

The lower-part structure 135 extends from the lower end of the side-part structure 133 toward the inner side in the radial direction along a plane perpendicular to the up-down direction, and covers the tool accessory 40 from below. The lower-part structure 135 is formed integrally with the upper-part structure 131 and the side-part structure 133.

Figure 5:
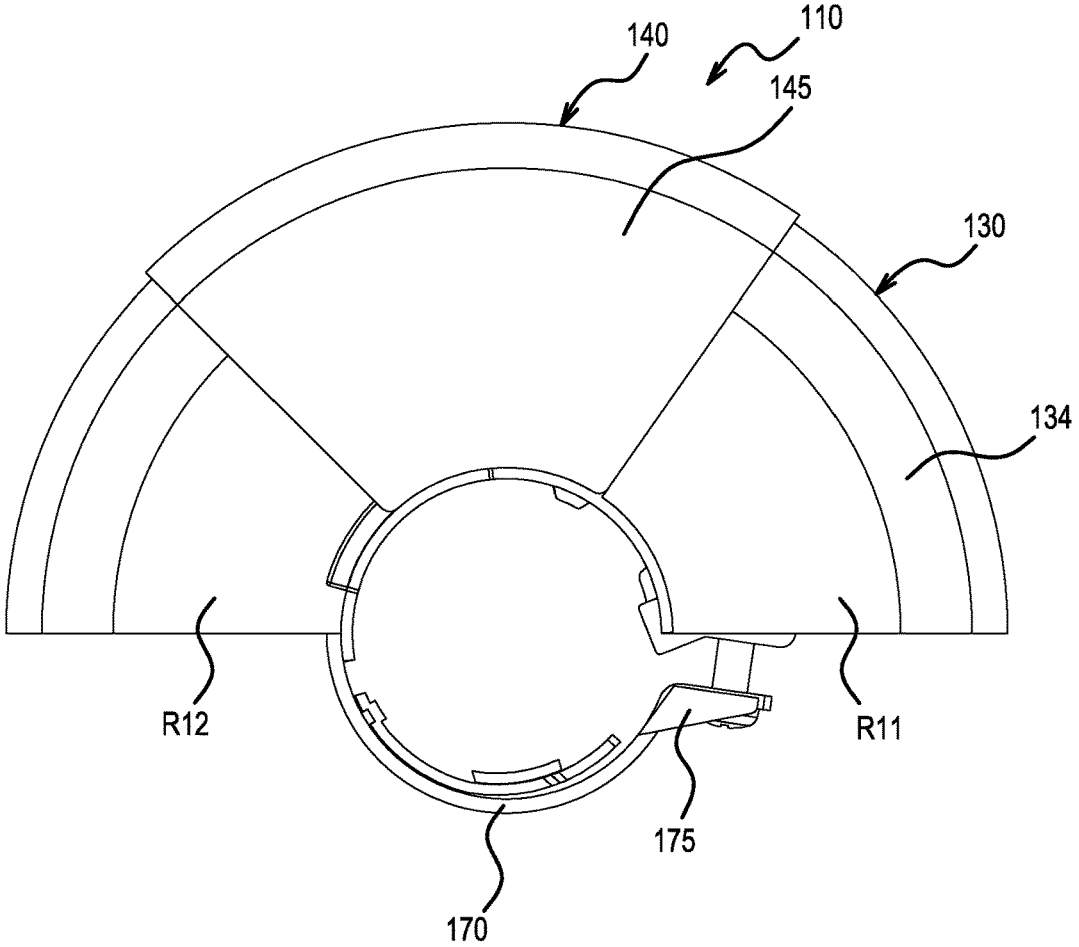
FIG. 5 is a bottom view that shows the first aspect of the protective cover according to the first embodiment.

In FIG. 5, the lower-part structure 135 is positioned such that it is overlapped by a lower-part structure 145 of the outer-side-cover part 140 and is hidden by the lower-part structure 145. Likewise, in FIG. 4, the lower-part structure 135, although not shown, extends from the lower end of the side-part structure 133 toward the inner side in the radial direction in an angular area corresponding to an upper-part structure 141 of the outer-side-cover part 140, and covers the tool accessory 40 from below.

As shown in FIG. 6, the main-cover part 130 comprises, on the outer surface and the inner surface of the upper-part structure 131, guide projections 132 for limiting (regulating) movement of the outer-side-cover part 140 and the inner-side-cover part 150 in the circumferential direction.

The circular-tubular part 170, which is concentric with an arc of the upper-part structure 131, is provided on the upper-part structure 131 of the main-cover part 130. The upper-part structure 131 has an extended portion 131A that extends upward at a location corresponding to the circular-tubular part 170 and is connected to the circular-tubular part 170 at the extended portion 131A. The circular-tubular part 170 is integrally configured with the extended portion or is configured as a structure separate from the extended portion.

As shown in FIG. 4, etc., the circular-tubular part 170 is formed into an open-ring shape, the same as in the circular-tubular part 67, and, on a portion that is open in the circumferential direction, a tightening part 175 is provided for tightening the circular-tubular part 170 to the cover-connection part 31 of the second gear housing 30.

The tightening part 175 functions such that, by changing the positional relationship between a screw and a nut that sandwich the tightening part 175 from both sides, an inner side of the circular-tubular part 170 is tightened to the cover-connection part 31 of the second gear housing 30. Owing to the function of the circular-tubular part 170, the main-cover part 130 of the protective cover 110 is fixed to the second gear housing 30. After the protective cover 110 is fitted onto the cover-connection part 31 of the second gear housing 30, the protective cover 110 is fixed to the cover-connection part 31 by being tightened thereto.

The outer-side-cover part 140 has an inner surface along the outer surface of the main-cover part 130 and is provided along the outer surface of the main-cover part 130 such that it is capable of relative movement in the circumferential direction. Specifically, the outer-side-cover part 140 comprises the fan-shaped upper-part structure 141 and a side-part structure 143, which extends downward from an outer-circumferential-end edge of the upper-part structure 141, and is configured such that it covers the tool accessory 40 from above and the side with the main-cover part 130.

Furthermore, as shown in FIG. 5, FIG. 6, etc., the outer-side-cover part 140 comprises the lower-part structure 145, which extends from the lower end of the side-part structure 143 toward the inner side in the radial direction along a plane perpendicular to the up-down direction and along a lower surface of the lower-part structure 135, and is configured such that the lower-part structure 145 covers the tool accessory 40 from below. The upper-part structure 141, the side-part structure 143, and the lower-part structure 145 are integrally formed of, for example, a metal material. The upper-part structure 141 and the lower-part structure 145 extend in the circumferential direction over an angular range the same as or slightly larger than the lower-part structure 135 of the main-cover part 130.

By providing the outer-side-cover part 140 such that it is capable of relative movement in the circumferential direction with respect to the main-cover part 130, the lower-part structure 145 covers, within the area below the tool accessory 40 and in the state in which the outer-side-cover part 140 is located at a first position with respect to the main-cover part 130, as shown in FIG. 4 and FIG. 5, an area that is substantially the same as the lower-part structure 135 of the main-cover part 130.

Figure 7:
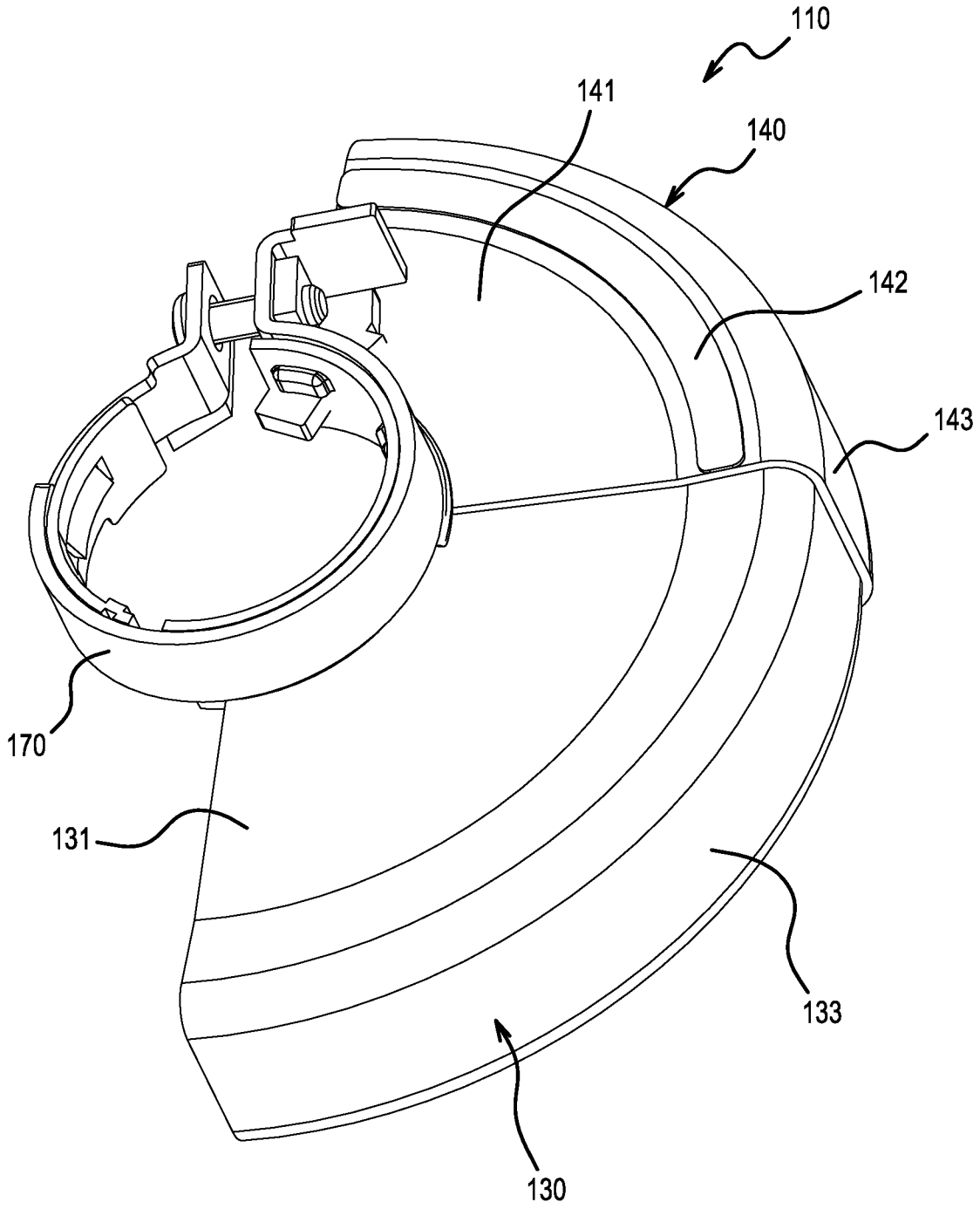
FIG. 7 is an oblique view, viewed from above, that shows a second aspect of the protective cover according to the first embodiment.

On the other hand, as shown in FIG. 7, FIG. 8, and FIG. 9, when the outer-side-cover part 140 is located at a second position with respect to the main-cover part 130, the outer-side-cover part 140 covers an area R11 among areas R11, R12 below the tool accessory 40 not covered by the main-cover part 130.

In addition, the upper-part structure 141 of the outer-side-cover part 140 has, on its inner surface, an elongate recess 142 (refer to FIG. 6) that extends in the circumferential direction and engages with the guide projection 132 provided on the outer surface of the main-cover part 130. It may be understood that the elongate recess 142 is a slit provided on the upper-part structure 141 and that the cover is provided such that it covers the slit. The cover that covers the slit can be provided as an anti-dust measure. The engagement of the elongate recess 142 and the guide projection 132 regulates (limits) the angle through which the outer-side-cover part 140 can move (slide) with respect to the main-cover part 130 in the circumferential direction.

The inner-side-cover part 150 has an outer surface along the inner surface of the main-cover part 130 and is provided such that it is capable of relative movement in the circumferential direction with respect to the inner surface of the main-cover part 130. Specifically, as shown in FIG. 6 and FIG. 8, the inner-side-cover part 150 comprises a fan-shaped upper-part structure 151 and a side-part structure 153, which extends downward from an outer-circumferential-end edge of the upper-part structure 151, and is configured such that the inner-side-cover part 150 covers the tool accessory 40 from above and the side. Furthermore, the inner-side-cover part 150 comprises a lower-part structure 155, which extends from the lower end of the side-part structure 153 toward the inner side in the radial direction along a plane perpendicular to the up-down direction and along an upper surface of the lower-part structure 135, and is configured such that the lower-part structure 155 covers the tool accessory 40 from below.

The upper-part structure 151, the side-part structure 153, and the lower-part structure 155 are integrally formed of, for example, a metal material. The same as in the outer-side-cover part 140, the upper-part structure 151 and the lower-part structure 155 extend in the circumferential direction over an angular range the same as or slightly larger than the lower-part structure 135 of the main-cover part 130.

By providing the inner-side-cover part 150 such that it is capable of relative movement in the circumferential direction with respect to the main-cover part 130, the lower-part structure 155 covers, within the area below the tool accessory 40 and when the inner-side-cover part 150 is positioned at the first position with respect to the main-cover part 130, as shown in FIG. 4, FIG. 5, and FIG. 6, an area that is substantially the same as the lower-part structure 135 of the main-cover part 130.

On the other hand, when the inner-side-cover part 150 is located at a third position with respect to the main-cover part 130, as shown in FIG. 7, FIG. 8, and FIG. 9, the inner-side-cover part 150 covers the area R12 among the areas R11, R12 below the tool accessory 40 not covered by the main-cover part 130.

The upper-part structure 151 of the inner-side-cover part 150 has, on its outer surface, an elongate recess 152 (refer to FIG. 6) that extends in the circumferential direction and engages with the guide projection 132 provided on the inner surface of the main-cover part 130. The same as in the elongate recess 142, it may be understood that the elongate recess 152 is a slit provided on the upper-part structure 151, and a cover that covers the slit is provided. The engagement of the elongate recess 152 and the guide projection 132 prevents the inner-side-cover part 150 from moving in the circumferential direction with respect to the main-cover part 130 beyond a predetermined angular range.

As explained above, in the grinder 100 of the present embodiment, the protective cover 110 comprises the plurality of cover parts 130, 140, 150. Furthermore, the outer-side-cover part 140 and the inner-side-cover part 150, which are second and third cover parts, are provided such that they are capable of relative movement in the circumferential direction with respect to the main-cover part 130, which is a first cover part. In the protective cover 110, the movement of the outer-side-cover part 140 and the inner-side-cover part 150 opens and closes the areas R11, R12 not covered by the main-cover part 130, and thereby the area of the tool accessory 40 covered by the protective cover 110 changes.

According to the protective cover 110, the user can adjust the area of the tool accessory 40 covered by the protective cover 110. For example, the user can, while considering the reduction of dust flying about, adjust the area below the tool accessory 40 that is covered by the protective cover 110 so that work efficiency is not reduced.

The adjustment can be performed, for example, to prevent interference between the tool accessory 40 and the workpiece during processing work or to prevent interference between the tool accessory 40 and the protective cover 110 when exchanging the tool accessory 40.

As is well known, the portion of the tool accessory 40 that is proximate to the workpiece during processing work differs according to the type of the tool accessory 40 and the processing method. In one operation, the lower surface of the tool accessory 40 is used in processing; in another operation, the side edge of the tool accessory 40 is used in processing. Accordingly, according to the grinder 100, in which the area below the tool accessory 40 covered by the protective cover 110 can be adjusted, high work efficiency is exhibited for the multiplicity of operations described above. In the grinder 100 shown in FIG. 9, the orientation of the circumferential direction of the protective cover 110 is further adjusted to an orientation that is suited to the cutting work.

Second Embodiment

The grinder 200 according to a second embodiment is configured by mounting a protective cover 210, which is shown in FIG. 10 to FIG. 14, on the grinder 1 shown in FIG. 1 or on a similar grinder.

The protective cover 210 comprises a main-cover part 230, an auxiliary-cover part 250, and a circular-tubular part 270, which is for fixing the main-cover part 230 to the second gear housing 30. The protective cover 210 is configured such that the area over which the tool accessory 40 is covered changes by the pivoting of the auxiliary-cover part 250 with respect to the main-cover part 230.

Figure 11:
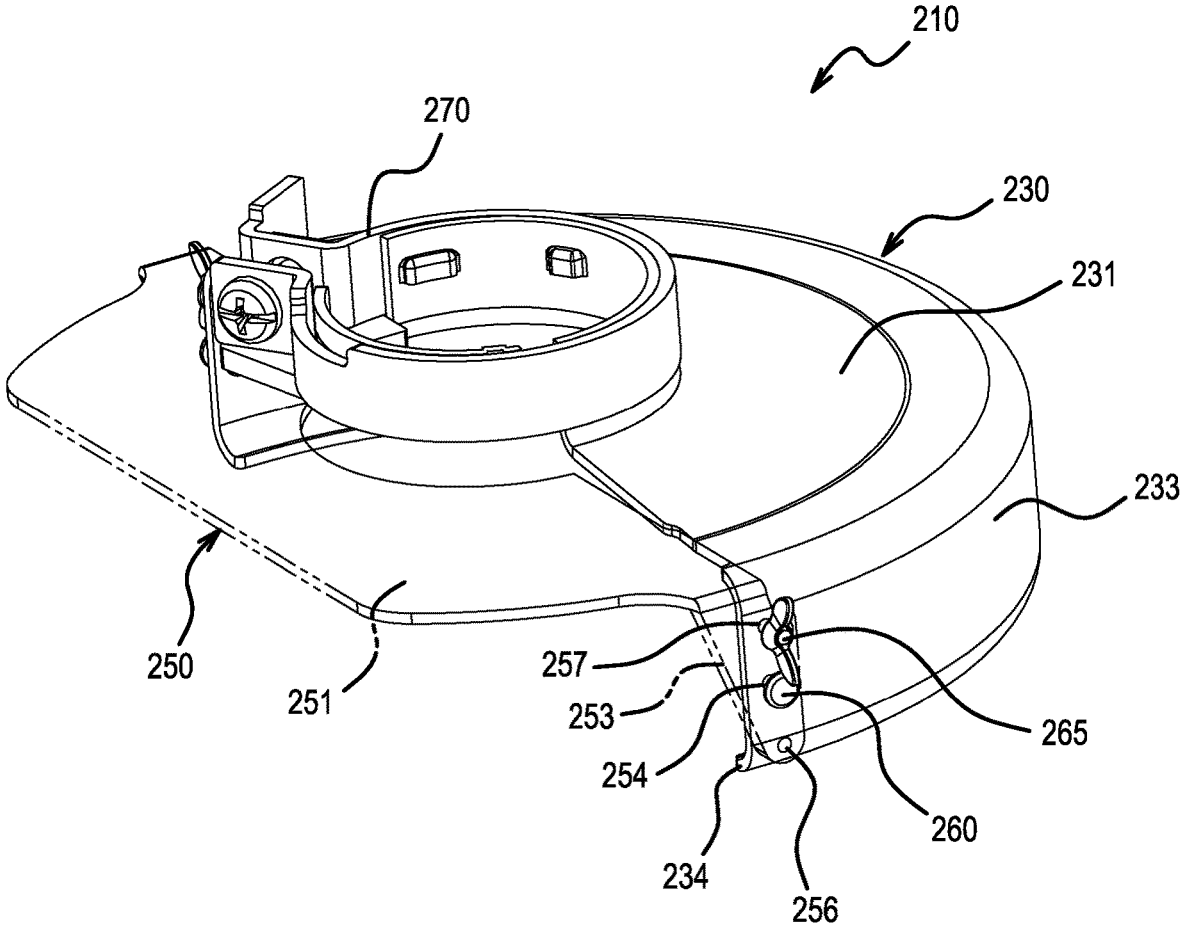
FIG. 11 is an oblique view that shows the first aspect of the protective cover according to the second embodiment.
Figure 12:
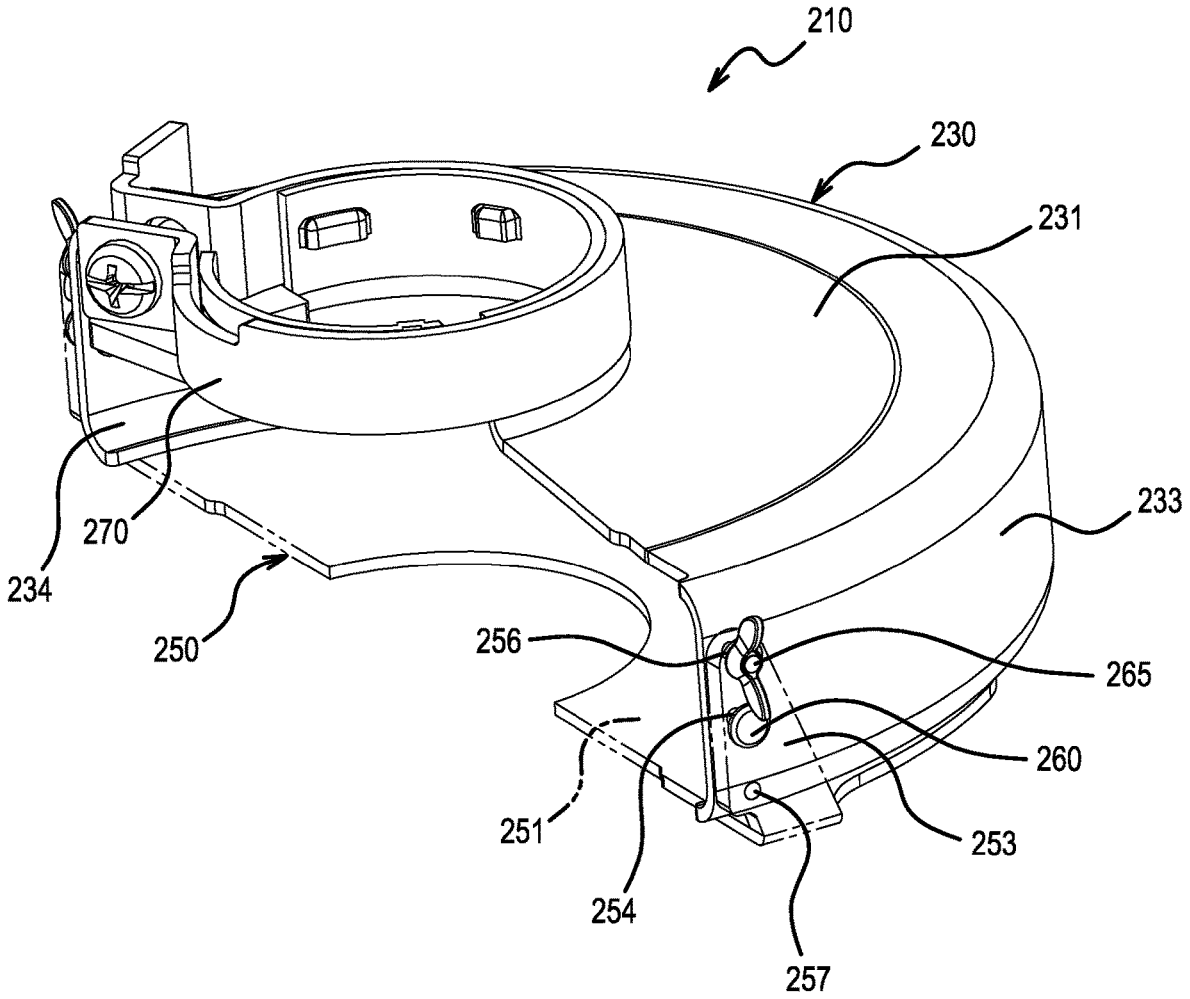
FIG. 12 is an oblique view that shows a second aspect of the protective cover according to the second embodiment.

Similar to the protective cover 60, the main-cover part 230 comprises a semicircular upper-part structure 231, which is for covering the rearward semicircular portion of the upper part of the tool accessory 40, and a side-part structure 233, which extends downward from an outer-circumferential-end edge of the upper-part structure 231, and is configured such that it extends in the circumferential direction of the spindle 24 and covers the tool accessory 40 from above and the side. The upper-part structure 231 and the side-part structure 233 are integrally formed of, for example, a metal material. The side-part structure 233 comprises, at its lower end, a curved part 234 that curves toward the inner side in the radial direction, as shown in FIG. 11 and FIG. 12.

Figure 13:
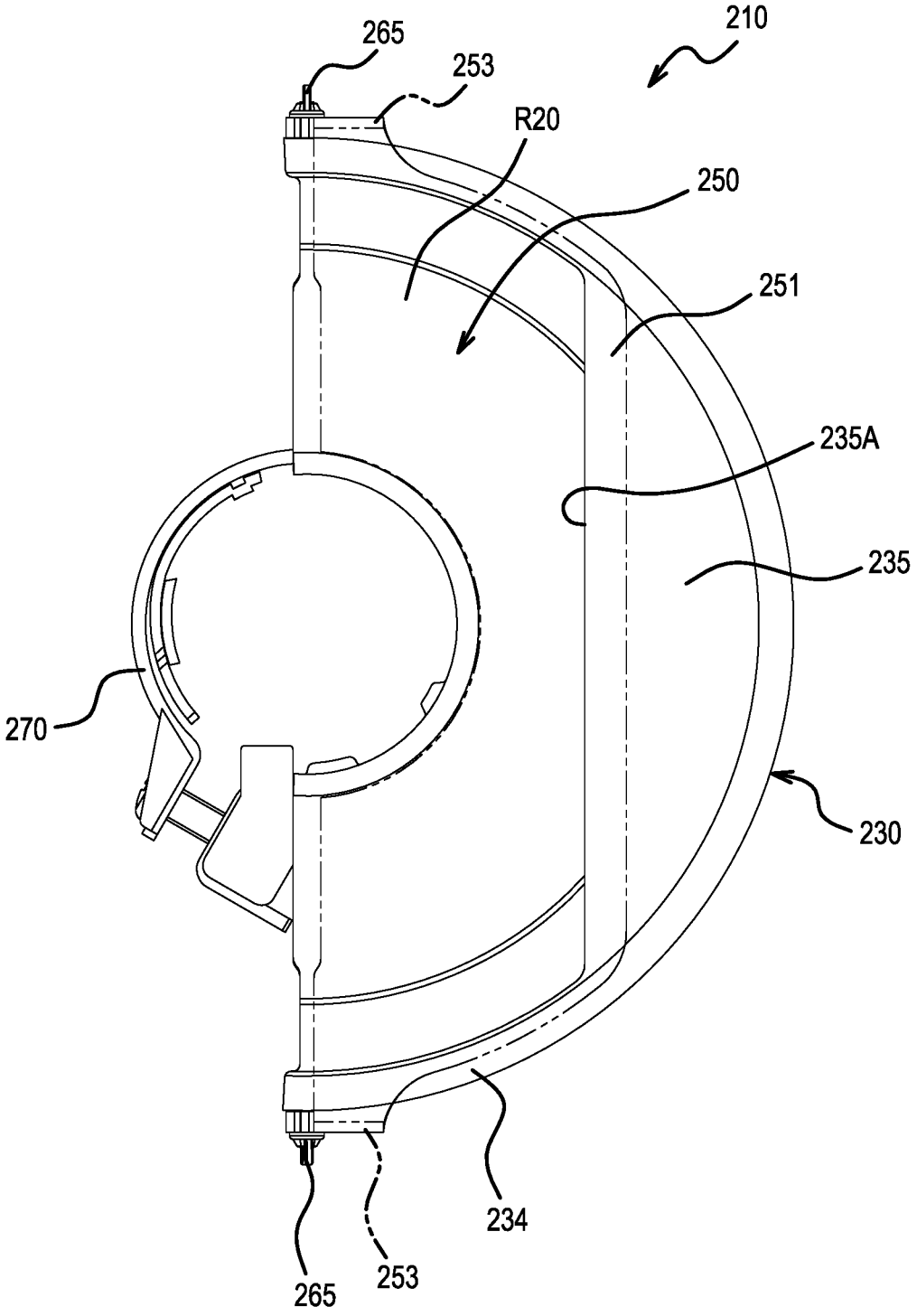
FIG. 13 is a bottom view that shows the second aspect of the protective cover according to the second embodiment.

As shown in FIG. 13, the main-cover part 230 further comprises a lower-part structure 235, which covers the tool accessory 40 from below. The lower-part structure 235 is formed integrally with the upper-part structure 231 and the side-part structure 233. The lower-part structure 235 is provided such that it extends just a small amount from the lower end (the curved part 234) of the side-part structure 233 toward the inner side in the radial direction along a plane perpendicular to the up-down direction, and thereby covers a rearward portion of the area below the upper-part structure 231.

An end edge 235A of the lower-part structure 235 extends linearly in the left-right direction, which is perpendicular to the up-down direction. An area R20 below the main-cover part 230, which is not covered by the lower-part structure 235, is covered by the auxiliary-cover part 250 when the auxiliary-cover part 250 is disposed below.

The circular-tubular part 270, which is configured the same as the circular-tubular part 170 of the first embodiment, is provided on the upper-part structure 231 of the main-cover part 230. The main-cover part 230 is fixed to the cover-connection part 31 of the second gear housing 30 using the circular-tubular part 270.

The auxiliary-cover part 250 is pivotably connected to the main-cover part 230 via pivot pins 260. The pivot pins 260 are inserted through through holes 254, which are provided in arms 253 of the auxiliary-cover part 250, and through holes (not shown), which are provided in forward left- and right-end-parts of the side-part structure 233 of the main-cover part 230, after which the pivot pins 260 are additionally tightened, and thereby the auxiliary-cover part 250 is held such that it can pivot around an axis in the left-right direction with respect to the main-cover part 230.

The auxiliary-cover part 250 comprises a cover main body 251 and the two arms 253. The arms 253 are provided on left and right end parts of the cover main body 251 such that the arms 253 are upright and perpendicular to the surface of the cover main body 251. The cover main body 251 and the arms 253 are integrally formed of a transparent resin material. Consequently, in FIG. 10 to FIG. 14, the area over which the auxiliary-cover part 250 is covered is shown in phantom view.

Figure 10:
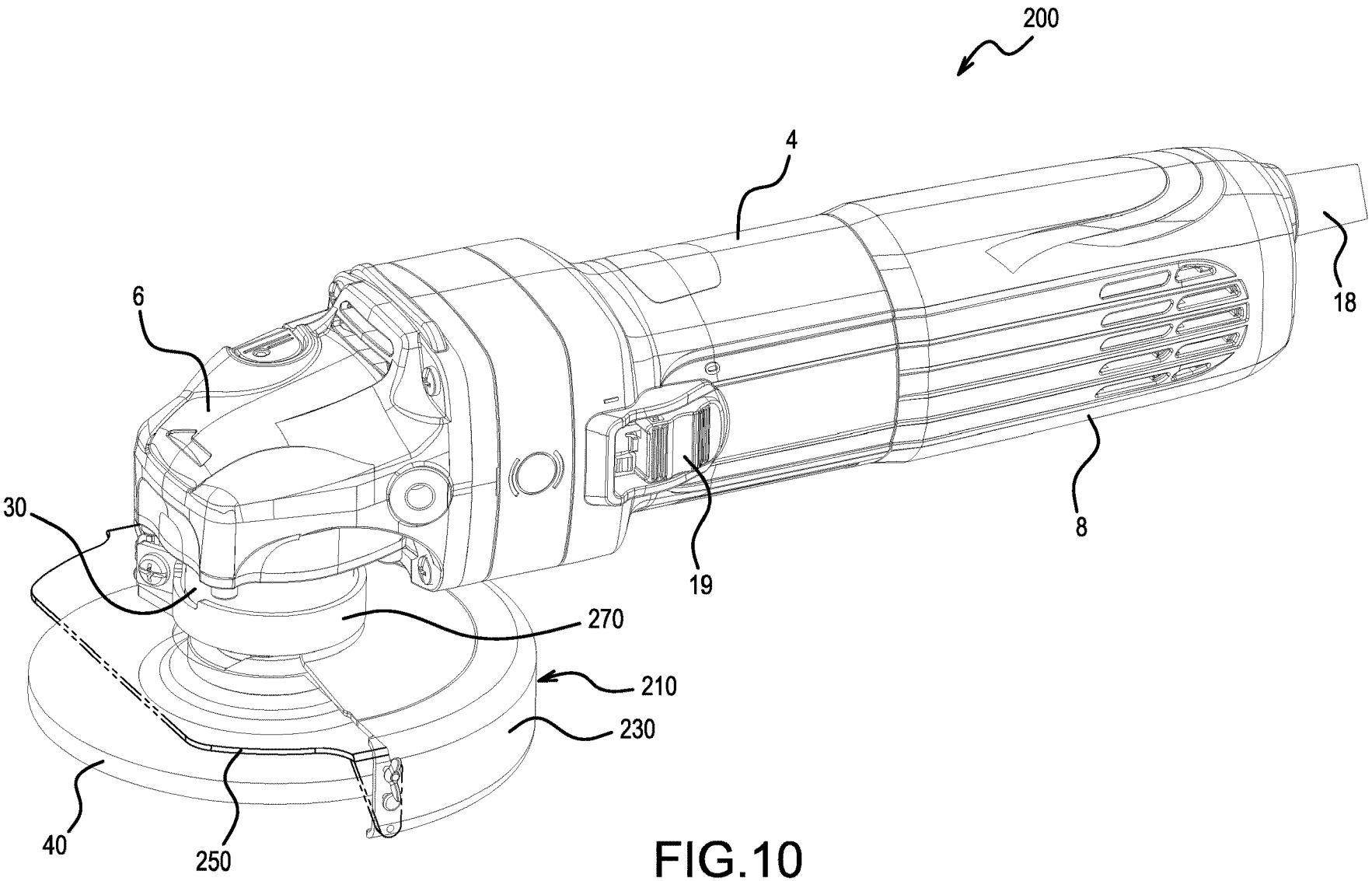
FIG. 10 is an oblique view that shows a first aspect of the grinder according to a second embodiment.

By the pivoting of the arms 253 around the axis along the left-right direction using the function of the pivot pins 260, the cover main body 251 covers, when the cover main body 251 is disposed at the first position with respect to the main-cover part 230, as shown in FIG. 10 and FIG. 11, an area above the tool accessory 40 not covered by the main-cover part 230.

Figure 14:
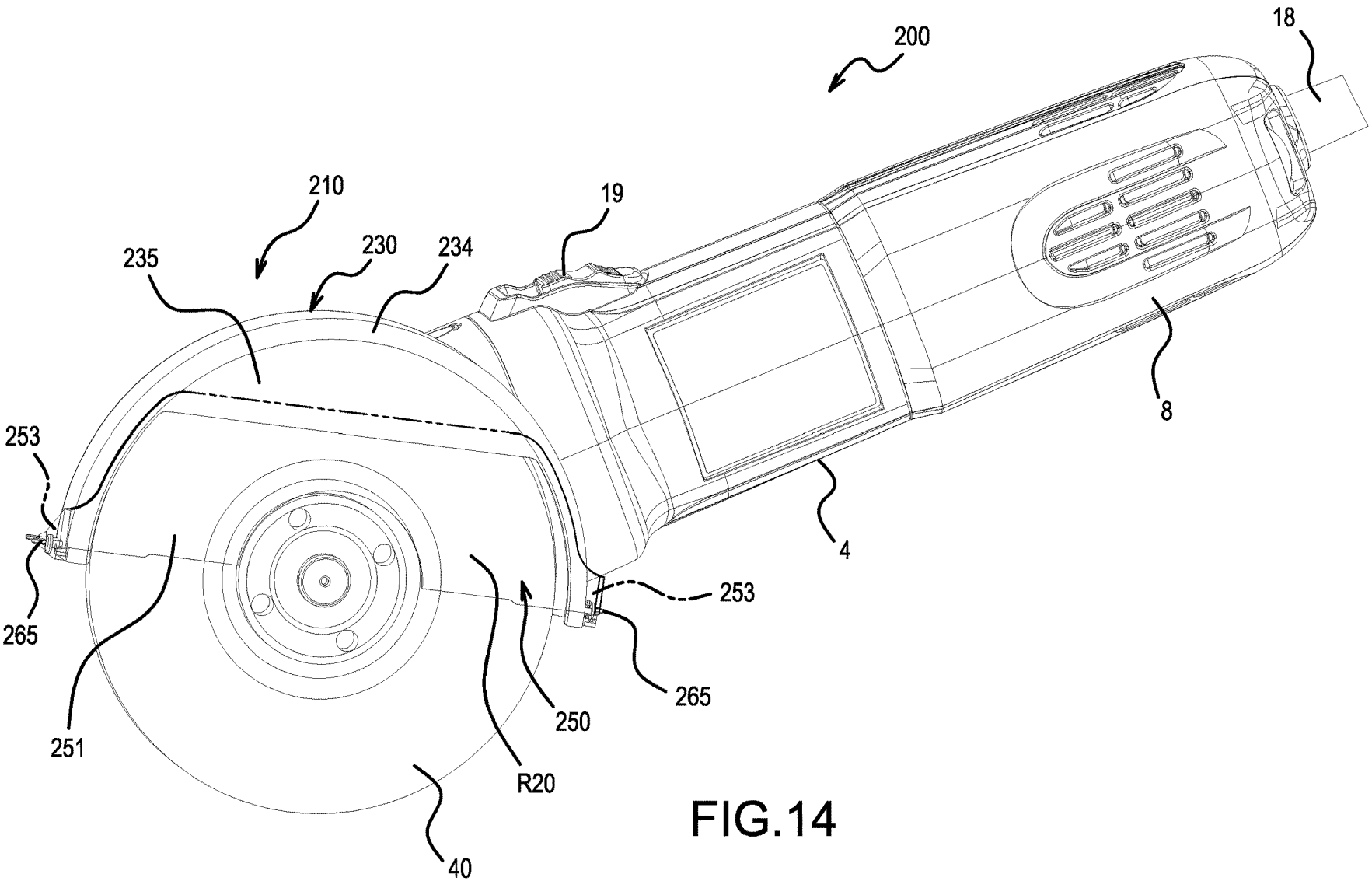
FIG. 14 is an oblique view that shows the second aspect of the grinder according to the second embodiment.

When the cover main body 251 is disposed at the second position with respect to the main-cover part 230, as shown in FIG. 12, FIG. 13, and FIG. 14, the cover main body 251 covers the area R20 below the tool accessory 40 not covered by the main-cover part 230. The user can adjust the area of the tool accessory 40 covered by the protective cover 210 by dismounting the tool accessory 40 from the spindle 24 and then operating the auxiliary-cover part 250 to dispose the auxiliary-cover part 250 at the first position or the second position.

The holding of the auxiliary-cover part 250 at the first or second position is accomplished by using screws 265. Through holes 256, 257 are provided in the arms 253 of the auxiliary-cover part 250. Screw holes (not shown), which communicate with the through holes 257 when the auxiliary-cover part 250 is disposed at the first position (refer to FIG. 11), are provided in the side-part structure 233 of the main-cover part 230. The through holes 256 are provided such that they communicate with the above-mentioned screw holes when the auxiliary-cover part 250 is disposed at the second position (refer to FIG. 12).

Consequently, the user can cause the auxiliary-cover part 250 to be held by the screws 265 at the first position by inserting, when the auxiliary-cover part 250 is disposed at the first position, the screws 265 through the through holes 257 and then screwing the screws 265 into the screw holes of the main-cover part 230. Likewise, the user can cause the auxiliary-cover part 250 to be held by the screws 265 at the second position by inserting, when the auxiliary-cover part 250 is disposed at the second position, the screws 265 through the through holes 256 and then screwing the screws 265 into the screw holes of the main-cover part 230.

As described above, the protective cover 210 comprises the plurality of cover parts 230, 250. The auxiliary-cover part 250, which is a second cover part, is provided such that it can pivot—with respect to the main-cover part 230, which is the first cover part that covers the tool accessory 40 from above—around an axis extending in the left-right direction, which is nonparallel and perpendicular to the axial direction of the spindle 24. Owing to this pivoting, the protective cover 210 is configured such that the area above or the area R20 below the tool accessory 40 not covered by the main-cover part 230 is covered by switching the position of the auxiliary-cover part 250.

In the present embodiment, the area of the tool accessory 40 covered by the protective cover 210 can be adjusted by operating the auxiliary-cover part 250 in this manner. Accordingly, the user can easily adjust the position of the auxiliary-cover part 250 in accordance with the type of the tool accessory 40 and the processing method, and thereby the workpiece can be processed with good work efficiency.

In particular, according to the present embodiment, the screws 265, which are in common, are used to hold the auxiliary-cover part 250 at the first and second positions. Because the screws 265 are used when the auxiliary-cover part 250 is located both at the first position and at the second position, it is possible to reduce the possibility that the user might lose the screws 265.

The auxiliary-cover part 250 is further configured such that, when the auxiliary-cover part 250 is interposed between the user and the portion of the workpiece to be processed, the user's view is not obstructed. Accordingly, it is possible to prevent a reduction in work efficiency caused by the user's view being blocked.

The auxiliary-cover part 250 is described above as being composed of a transparent resin material. Nevertheless, it may be understood that the cover main body 251 shown in FIG. 10 to FIG. 14 may be composed of a mesh material such as wire mesh. The mesh size can be set such that large debris does not fly through the cover main body 251 during processing work. The cover main body 251 may also be configured by providing fine through holes dispersed in an opaque material. In this configuration, too, the cover main body 251 can be configured such that the user's view is not blocked.

Third Embodiment

The grinder 300 according to a third embodiment is configured by mounting a protective cover 310, which is shown in FIG. 15 to FIG. 18, on the grinder 1 shown in FIG. 1 or on a similar grinder.

The protective cover 310 comprises a main-cover part 330, an auxiliary-cover part 350, and a circular-tubular part 370, which is for fixing the main-cover part 330 to the second gear housing 30. The protective cover 310 is configured such that the area over which the tool accessory 40 is covered changes by the relative movement of the auxiliary-cover part 350 with respect to the main-cover part 330 in the up-down direction, which is the axial direction of the spindle 24.

Figure 16:
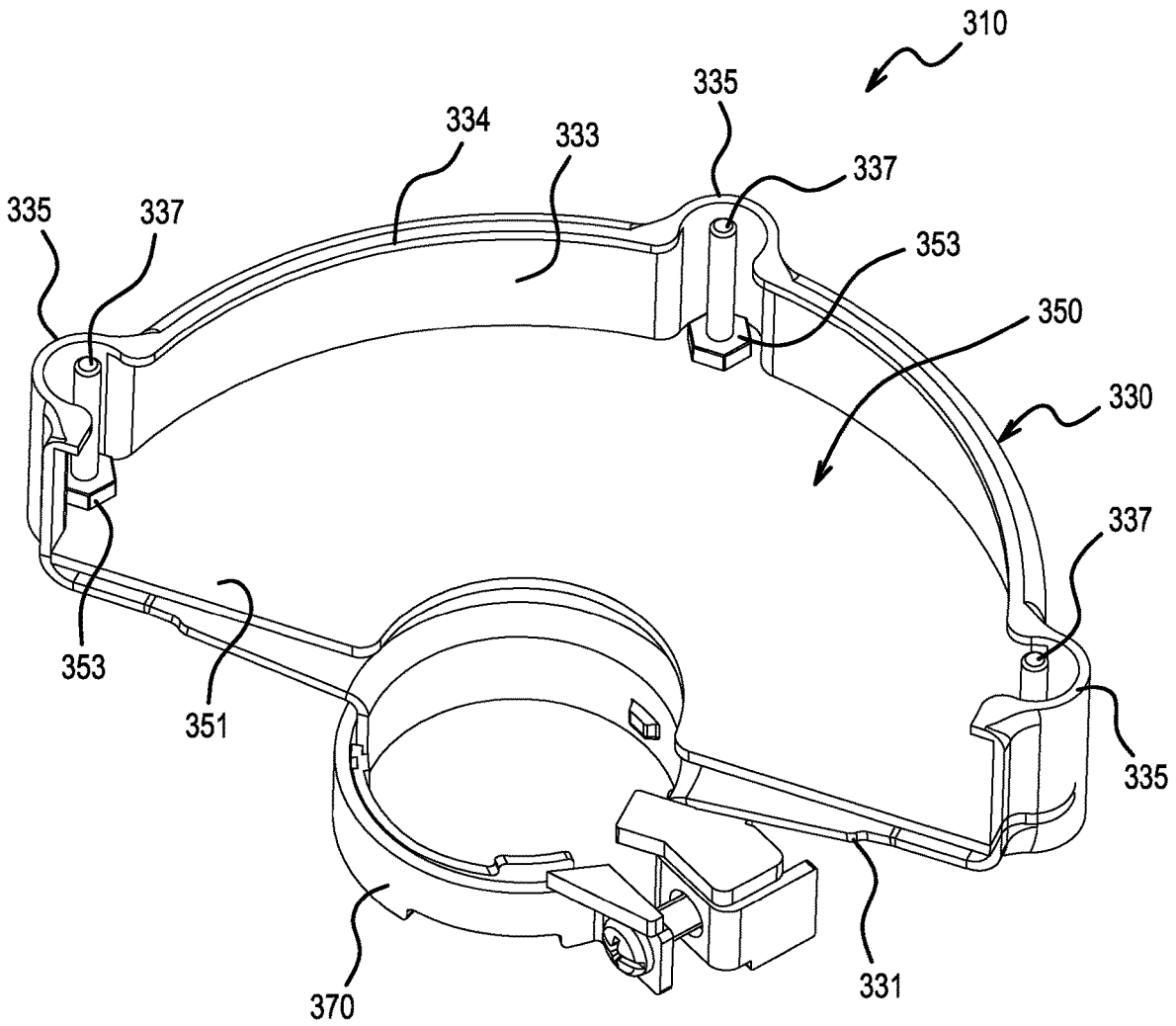
FIG. 16 is an oblique view, viewed from below, that shows the first aspect of the protective cover according to the third embodiment.

Similar to the protective cover 60, the main-cover part 330 comprises a semicircular upper-part structure 331, which is for covering a rearward semicircular portion of an upper part of the tool accessory 40. The main-cover part 330 also comprises a side-part structure 333, which extends downward from an outer-circumferential-end edge of the upper-part structure 331, and is configured such that it extends in the circumferential direction of the spindle 24 and covers the tool accessory 40 from above and the side. The upper-part structure 331 and the side-part structure 333 are integrally formed of, for example, a metal material. As shown in FIG. 16, the side-part structure 333 comprises, at its lower end, a curved part 334 that curves toward the inner side in the radial direction.

The main-cover part 330 further has, in partial areas of the side-part 333, a plurality of screw-housing parts 335 that houses screws 337 or similar threaded structures, which are inserted downward through the upper-part structure 331 from the upper surface of the upper-part structure 331. The screws 337 are housed in the screw-housing parts 335 such that they do not move in the up-down direction owing to, for example, the action of circlips 336. The screws 337 screw into nuts 353, which are fixed to a cover main body 351 that constitutes the auxiliary-cover part 350.

The circular-tubular part 370, which is configured the same as the circular-tubular part 170 of the first embodiment, is provided on the upper-part structure 331 of the main-cover part 330. The main-cover part 330 is fixed to the cover-connection part 31 of the second gear housing 30 using the circular-tubular part 370.

The auxiliary-cover part 350 comprises the cover main body 351, which opposes the inner surface (lower surface) of the upper-part structure 331 of the main-cover part 330, and the plurality of nuts 353, which is disposed on and fixed to the cover main body 351.

The cover main body 351 is composed of a semicircular metal plate or resin plate having a contour that follows along the inner surface of the side-part structure 333 and the screw-housing parts 335 of the main-cover part 330. The cover main body 351 is opaque, transparent, or a mesh.

The nuts 353 are provided in areas of the cover main body 351 that correspond to the locations at which the screws 337 are located in the main-cover part 330, and are provided such that the screws 337 screw into the nuts 353. The nuts 353 are fixed to the cover main body 351 such that the nuts 353 do not rotate even if the screws 337 are rotated.

In the protective cover 310 configured in this manner, as a result of the nuts 353 being fixed to the cover main body 351, when the screws 337, which screw into the nuts 353, are rotated by the user, the cover main body 351 moves up and down in accordance with the direction of that rotation. According to this principle, the auxiliary-cover part 350 is provided such that it is capable of relative movement in the up-down direction with respect to the main-cover part 330.

Figure 15:
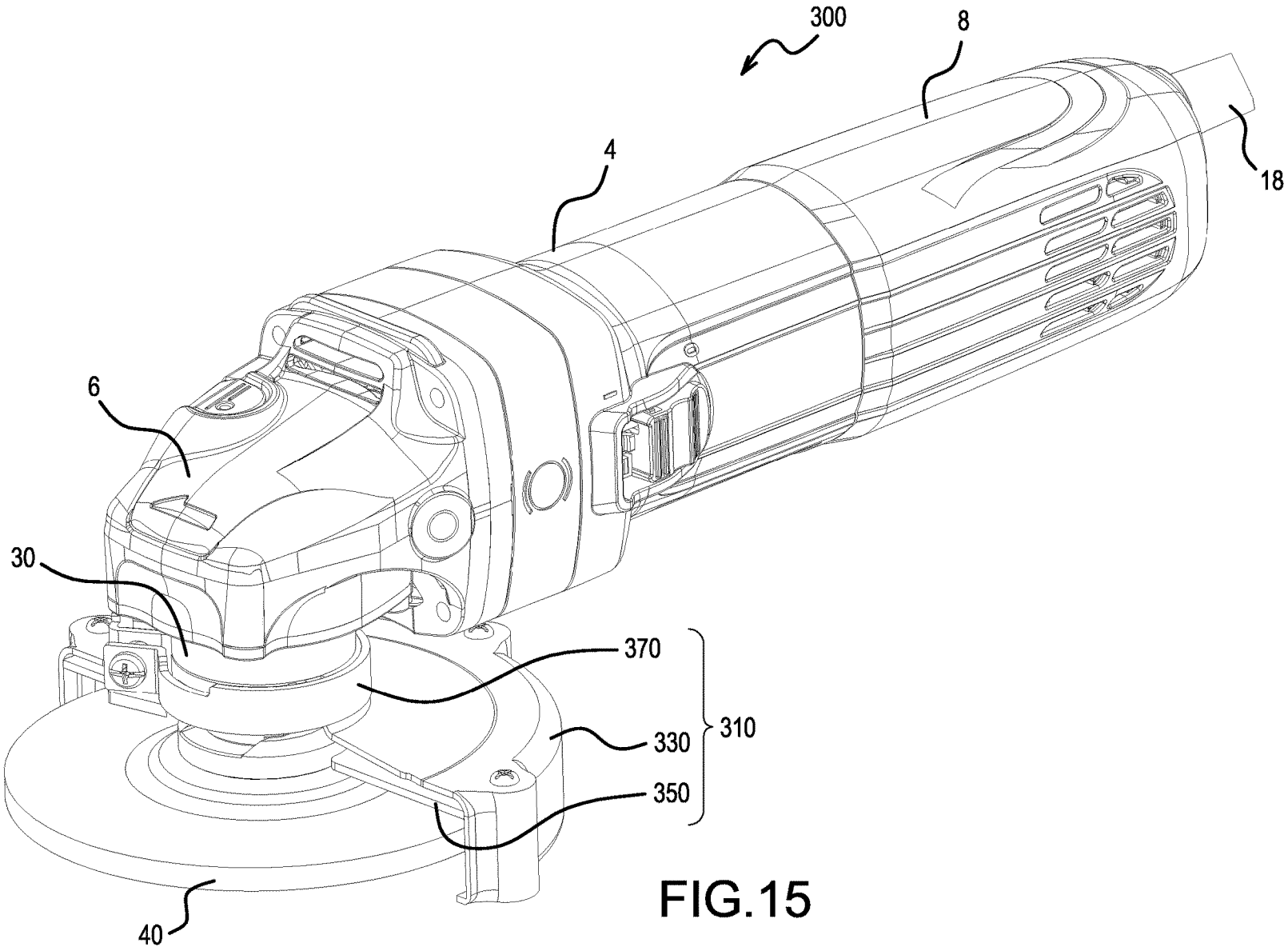
FIG. 15 is an oblique view that shows a first aspect of the grinder according to a third embodiment.

When the cover main body 351 is disposed at the first position with respect to the main-cover part 330, as shown in FIG. 15 and FIG. 16, the cover main body 351 approaches the inner surface of the upper-part structure 331 of the main-cover part 330 owing to the vertical movement of the auxiliary-cover part 350 and, together with the upper-part structure 331, covers the tool accessory 40 from above.

Figure 17:
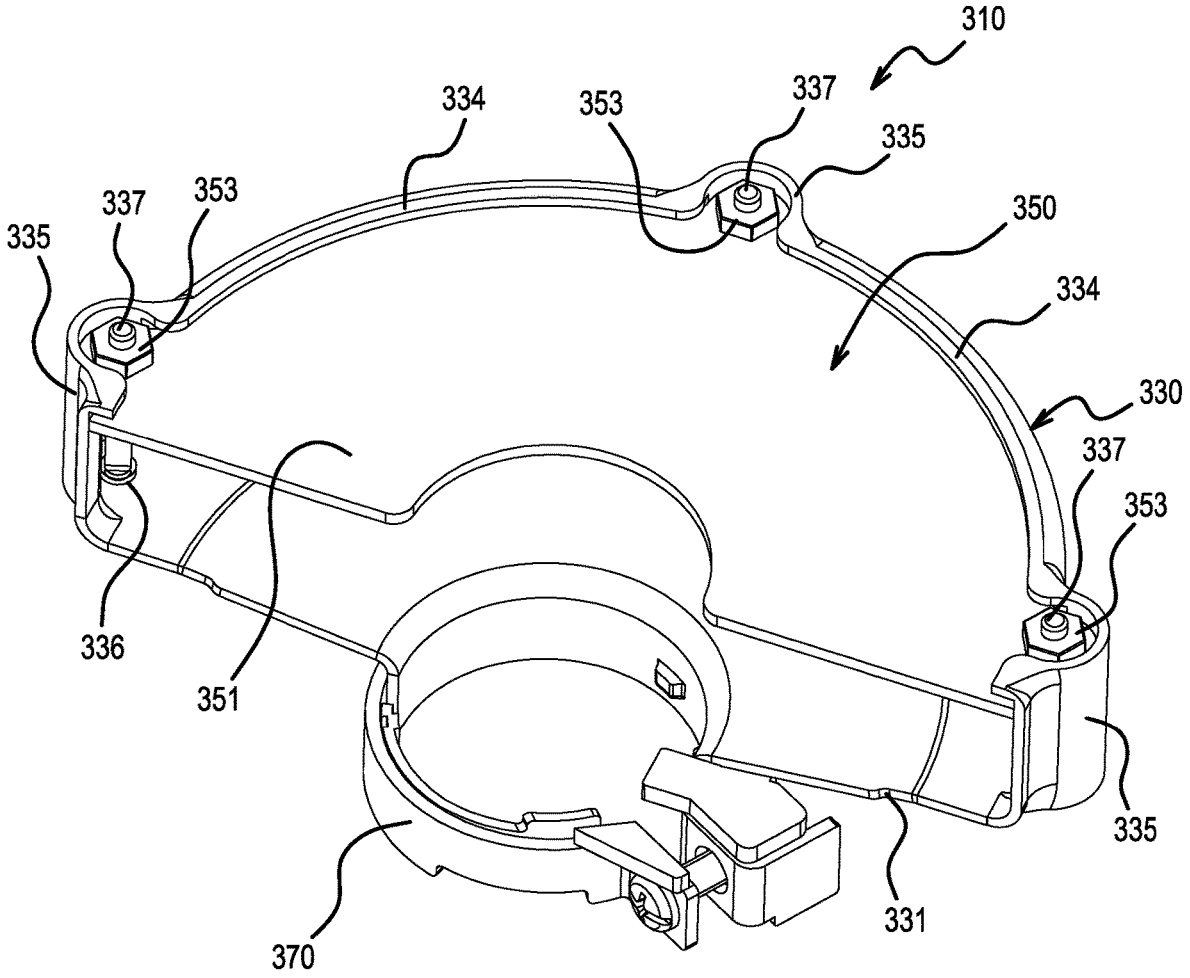
FIG. 17 is an oblique view, viewed from below, that shows a second aspect of the protective cover according to the third embodiment.
Figure 18:
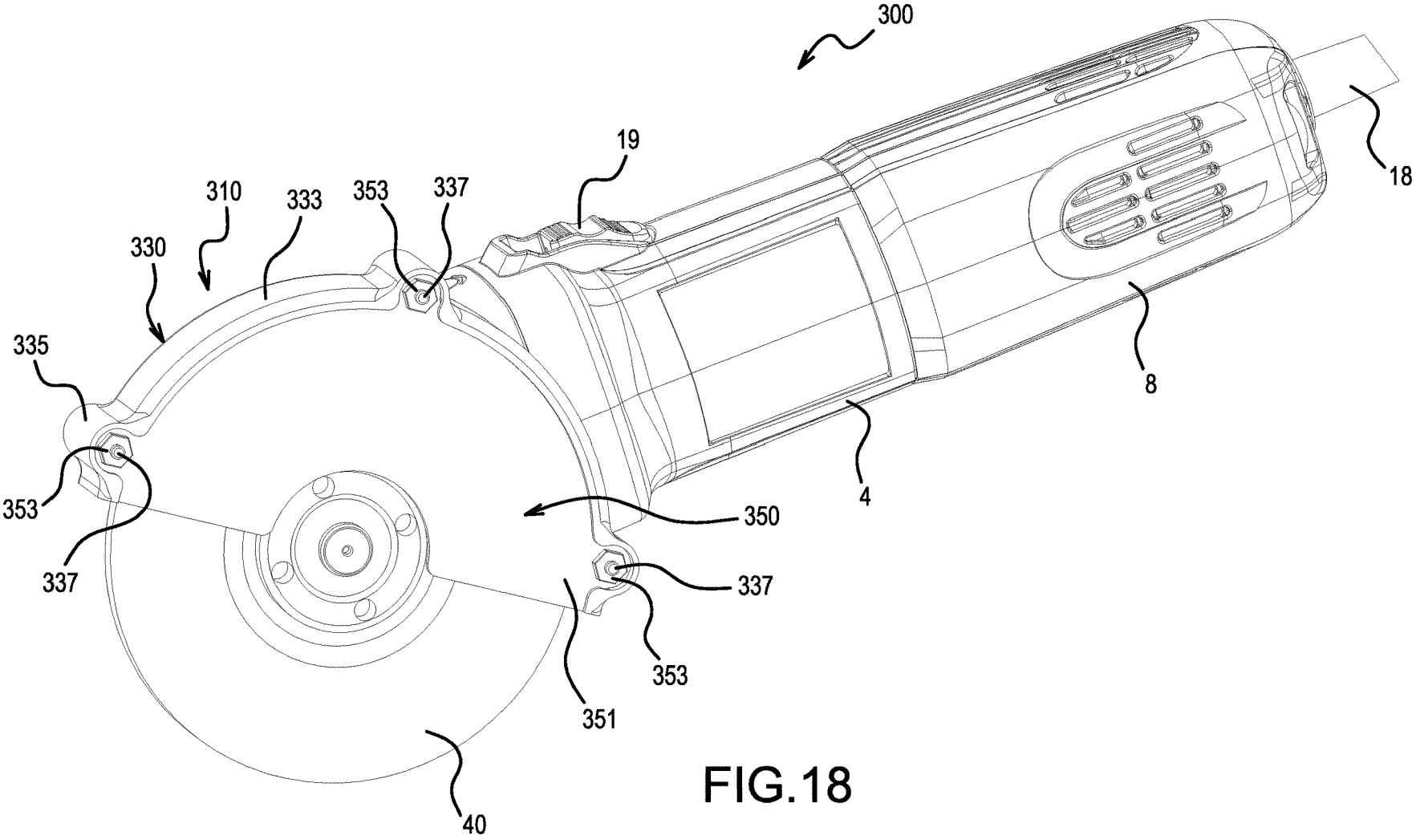
FIG. 18 is an oblique view that shows the second aspect of the grinder according to the third embodiment.

The cover main body 351 functions such that, in the state in which the cover main body 351 is disposed at the second position with respect to the main-cover part 330, as shown in FIG. 17 and FIG. 18, a space that houses the tool accessory 40 is formed between the cover main body 351 and the inner surface of the main-cover part 330 that faces the tool accessory 40, and thereby the tool accessory 40 is covered from below. The user can switch between the presence and absence of a covering below the tool accessory 40 by dismounting the tool accessory 40 from the spindle 24 and then rotating the screws 337 to move the auxiliary-cover part 350 up and down, thereby switching the position of the auxiliary-cover part 350.

If a cutting stone is used as the tool accessory 40, then the tool accessory 40 is disposed perpendicular to the workpiece, and the workpiece is processed using the side edge of the tool accessory 40. In this state, there is a possibility that the underside of the tool accessory 40 will face toward the user. Accordingly, by switching the state of the protective cover 310 such that the area below the tool accessory 40 is covered by the auxiliary-cover part 350, the user can perform cutting work while preventing dust or the like from below from flying about.

On the other hand, if processing work is to be performed on a workpiece using a grinding stone, then there is a possibility that the auxiliary-cover part 350, which covers the tool accessory 40 from below, will interfere with the workpiece, thereby reducing work efficiency. In this case, by disposing the auxiliary-cover part 350 above the tool accessory 40 so that the area below the tool accessory 40 is not covered, the user can perform processing on the workpiece with good work efficiency.

If the auxiliary-cover part 350 is composed of a transparent material, then it is possible to prevent the auxiliary-cover part 350 from blocking the user's view of the portion of the workpiece to be processed, and consequently the user can perform precision processing work with good efficiency.

Fourth Embodiment

The grinder 400 according to a fourth embodiment is configured such that a protective cover 410 shown in FIG. 19 to FIG. 26 is mounted on the grinder 1 shown in FIG. 1 or on a similar grinder.

The protective cover 410 comprises a main-cover part 430, an outer-side-cover part 450, and a circular-tubular part 470, which is for fixing the main-cover part 430 to the second gear housing 30. The protective cover 410 is configured such that the area over which the tool accessory 40 is covered from below changes by the movement of the outer-side-cover part 450 with respect to the main-cover part 430 in a transverse direction along the upper surface of the main-cover part 430 (e.g., refer to FIG. 24 and FIG. 26). The transverse direction means a direction along a plane perpendicular to the up-down direction. The outer-side-cover part 450 is disposed such that, when the main-cover part 430 is housed on the inner side of the outer-side-cover part 450, the outer-side-cover part 450 pivots in the transverse direction around an axis of a pivot pin 440, which extends in the up-down direction.

Figure 22:
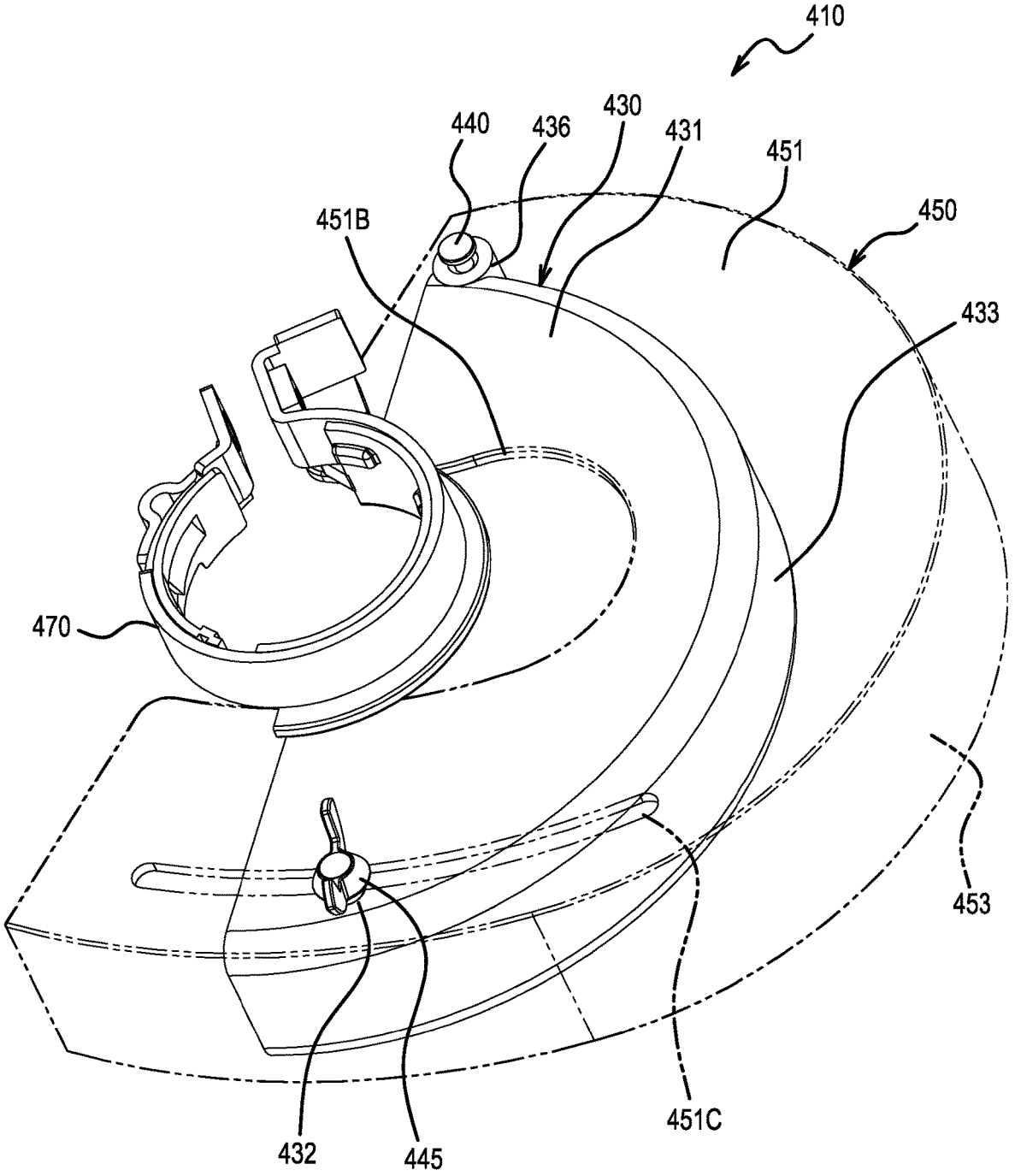
FIG. 22 is a partial, see-through oblique view that shows a second aspect of the protective cover according to the fourth embodiment.
Figure 23:
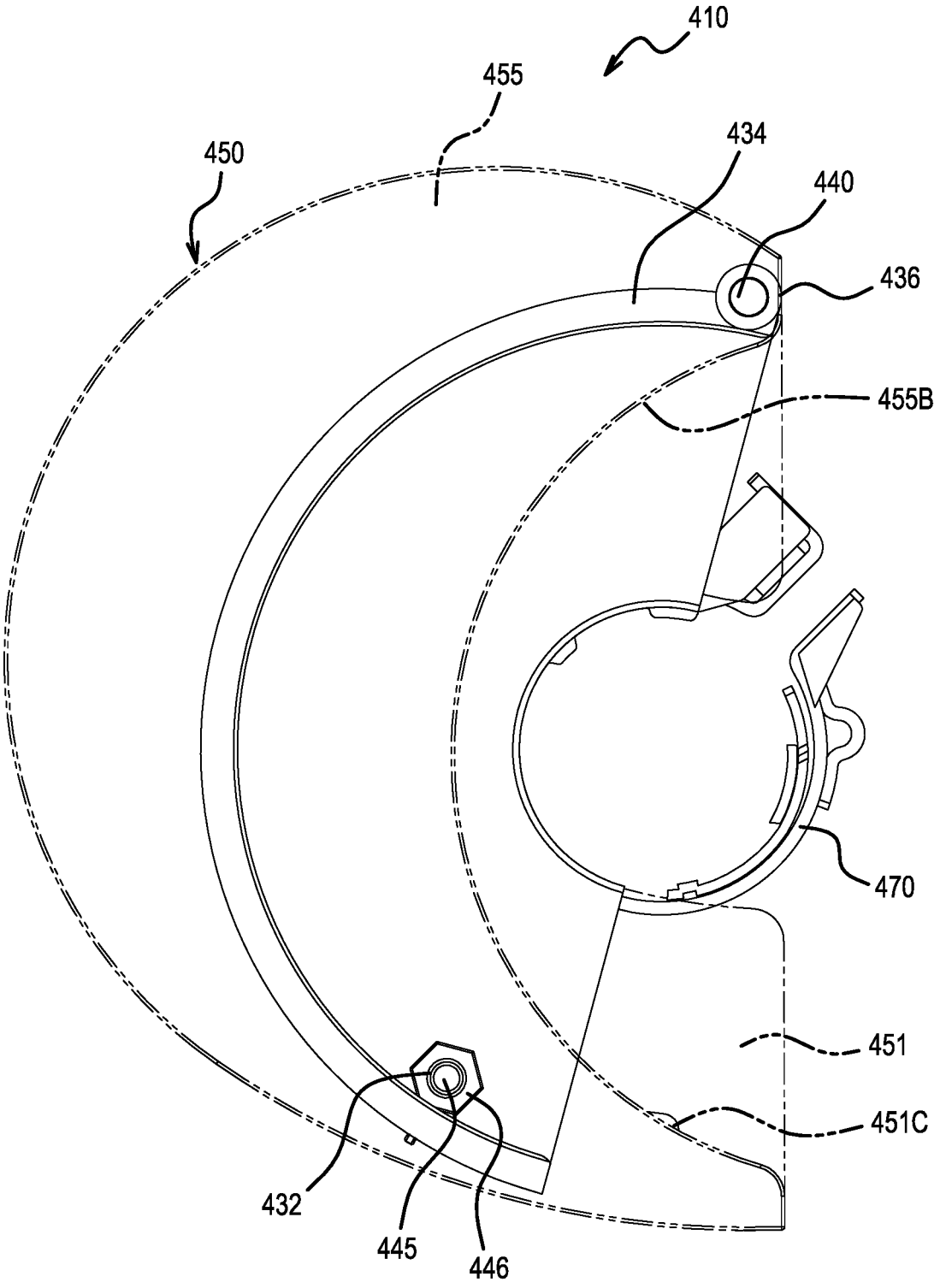
FIG. 23 is a partial, see-through bottom view that shows the second aspect of the protective cover according to the fourth embodiment.
Figure 24:
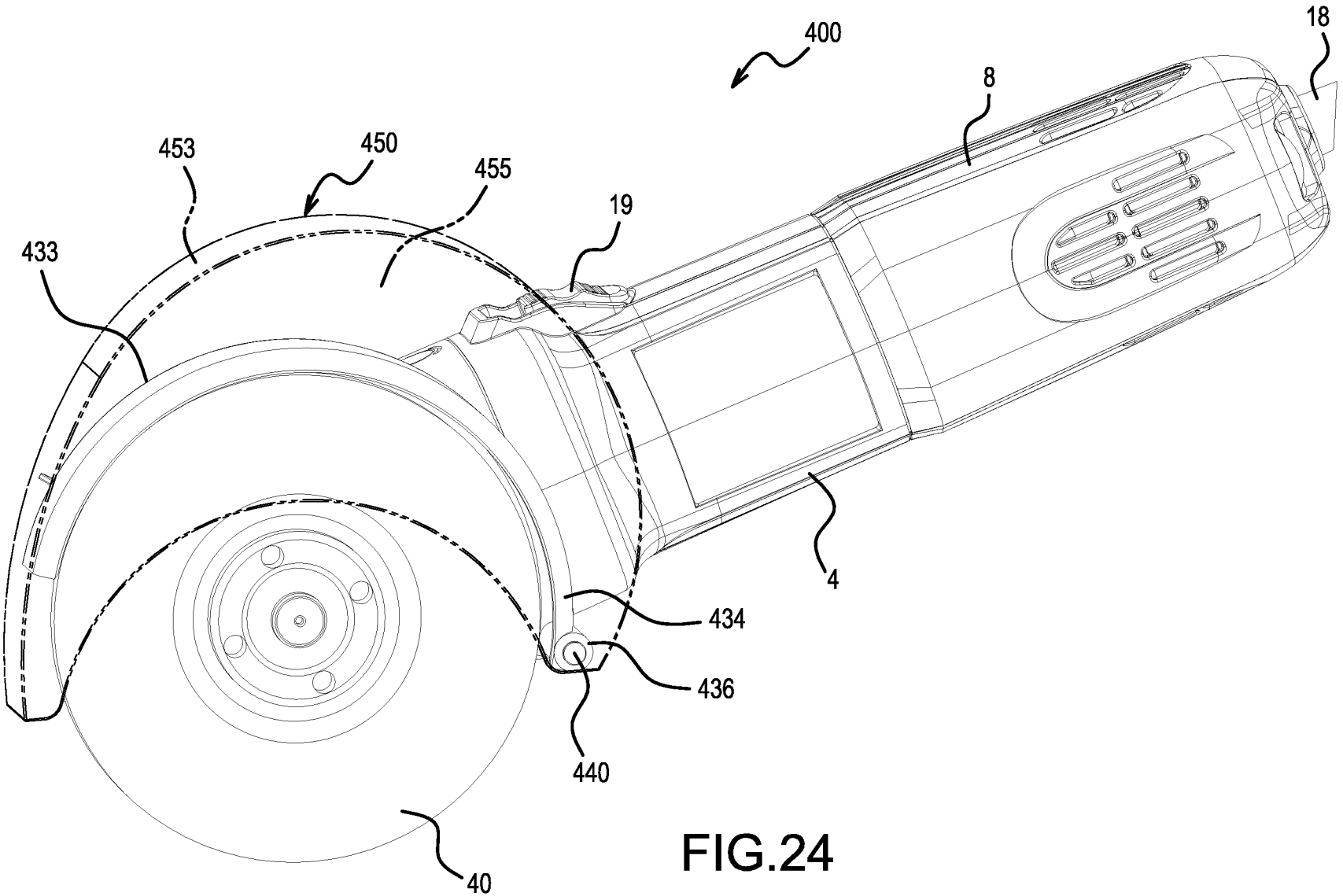
FIG. 24 is a partial, see-through oblique view that shows the second aspect of the grinder according to the fourth embodiment.

Similar to the protective cover 60, the main-cover part 430 comprises: a semicircular upper-part structure 431 for covering the rearward semicircular portion of the upper part of the tool accessory 40; and a side-part structure 433 that extends downward from an outer-circumferential-end edge of the upper-part structure 431 (refer to FIG. 22). The upper-part structure 431 and the side-part structure 433 are integrally formed of, for example, a metal material. The side-part structure 433 comprises, at its lower end, a curved part 434 that curves toward the inner side in the radial direction, as shown in FIG. 23 and FIG. 24.

The main-cover part 430 is configured such that, although it covers the rear part of the tool accessory 40 from above and the side, it does not substantially cover the area below the tool accessory 40. In FIG. 22, FIG. 23, and FIG. 24, to make it easy to understand the arrangement of the main-cover part 430 and the outer-side-cover part 450, the outer-side-cover part 450 is shown in phantom view, and thereby the portion of the main-cover part 430 located on the inner side of the outer-side-cover part 450 is visible.

The circular-tubular part 470, which is configured the same as the circular-tubular part 170 of the first embodiment, is provided on the upper-part structure 431 of the main-cover part 430. The main-cover part 430 is fixed to the cover-connection part 31 of the second gear housing 30 using the circular-tubular part 470.

The main-cover part 430 further has, on a forward-right-end part of the side-part structure 433, a pin-housing part 436 that houses the pivot pin 440. The pivot pin 440 is inserted through an upper-part through hole 451A of the outer-side-cover part 450, the pin-housing part 436 of the main-cover part 430, and a lower-part through hole 455A of the outer-side-cover part 450, which are in communication with one another, and is then additionally tightened; thereby, the outer-side-cover part 450 is joined to the main-cover part 430 such that the outer-side-cover part 450 can pivot in the transverse direction along the upper surface of the main-cover part 430.

The main-cover part 430 is further configured such that it has, near a forward-left-end part of the upper-part structure 431, an insertion hole 432 through which a screw 445 or similar threaded fastener is inserted. The screw 445 shown in FIG. 19 to FIG. 23 and FIG. 25 is inserted into the insertion hole 432 and screwed into a nut 446 located at the lower end of the insertion hole 432. The screw 445 is fixed to the main-cover part 430 such that the outer-side-cover part 450 does not move in the transverse direction if the screw 445 is firmly tightened to the outer-side-cover part 450 and the main-cover part 430 by virtue of the screw 445 being screwed into the nut 446 through a slit 451C of the outer-side-cover part 450 and the insertion hole 432 of the main-cover part 230. If movement of the outer-side-cover part 450 is required, then the user loosens the screw 445.

The outer-side-cover part 450 comprises: an upper-part structure 451, which is located above the main-cover part 430 and has a surface area greater than that of the upper-part structure 431 of the main-cover part 430; a side-part structure 453, which extends downward from an outer circumference of the upper-part structure 451; and a lower-part structure 455, which extends from a lower end of the side-part structure 453 toward the inner side in the radial direction.

The upper-part structure 451 comprises the upper-part through hole 451A, an opening 451B, and the slit 451C. The pivot pin 440 is inserted through the upper-part through hole 451A. To avoid impeding the movement of the outer-side-cover part 450 at the portion where the circular-tubular part 470 and the upper-part structure 431 communicate with one another, the opening 451B is provided in the area of the upper-part structure 451 that becomes a passageway of the circular-tubular part 470 when the outer-side-cover part 450 pivots around the axis of the pivot pin 440. The slit 451C is provided in the area of the upper-part structure 451 that becomes the passageway of the screw 445, which is attached to the main-cover part 430, when the outer-side-cover part 450 pivots around the axis of the pivot pin 440.

Figure 19:
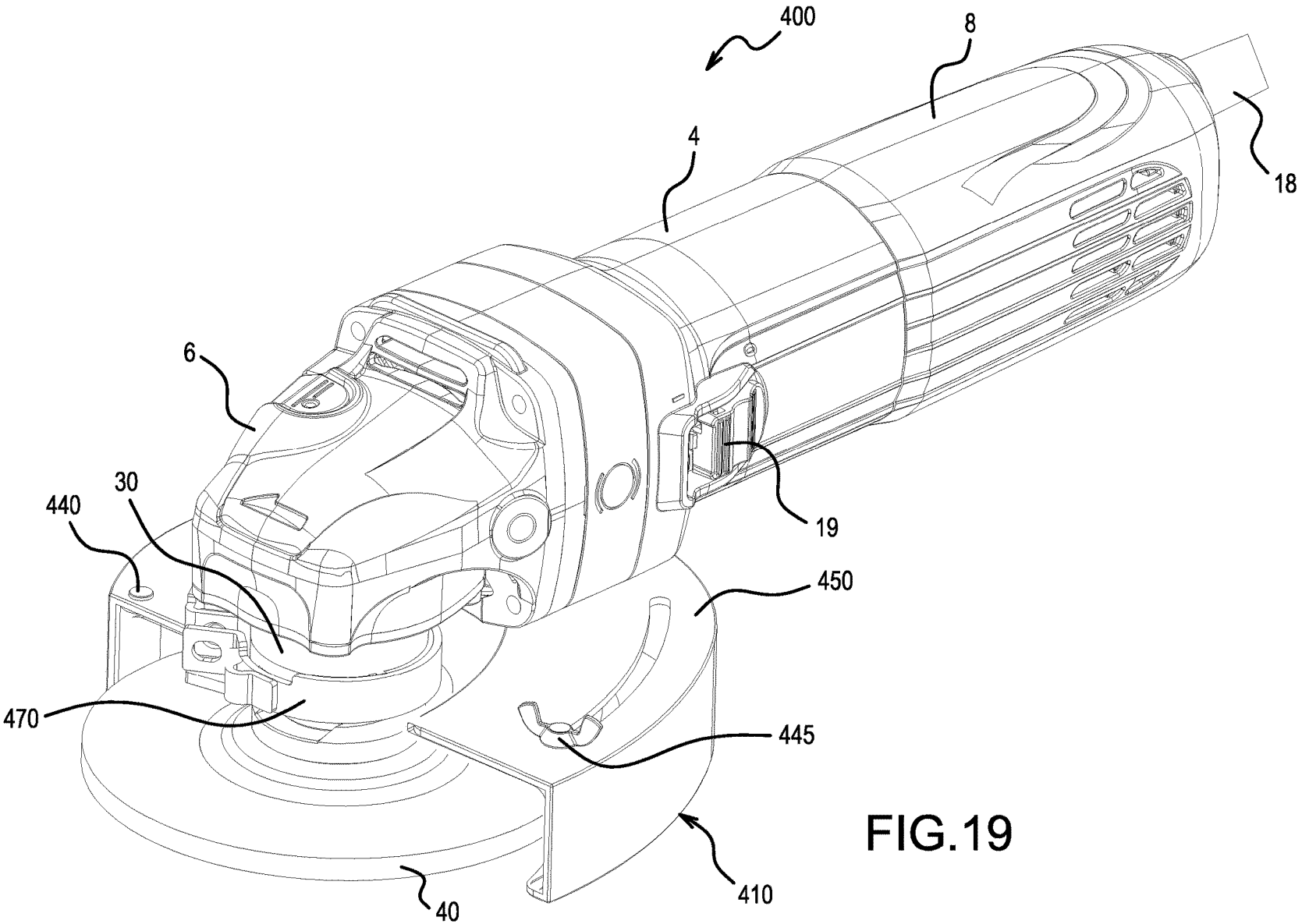
FIG. 19 is an oblique view that shows a first aspect of the grinder according to a fourth embodiment.
Figure 20:
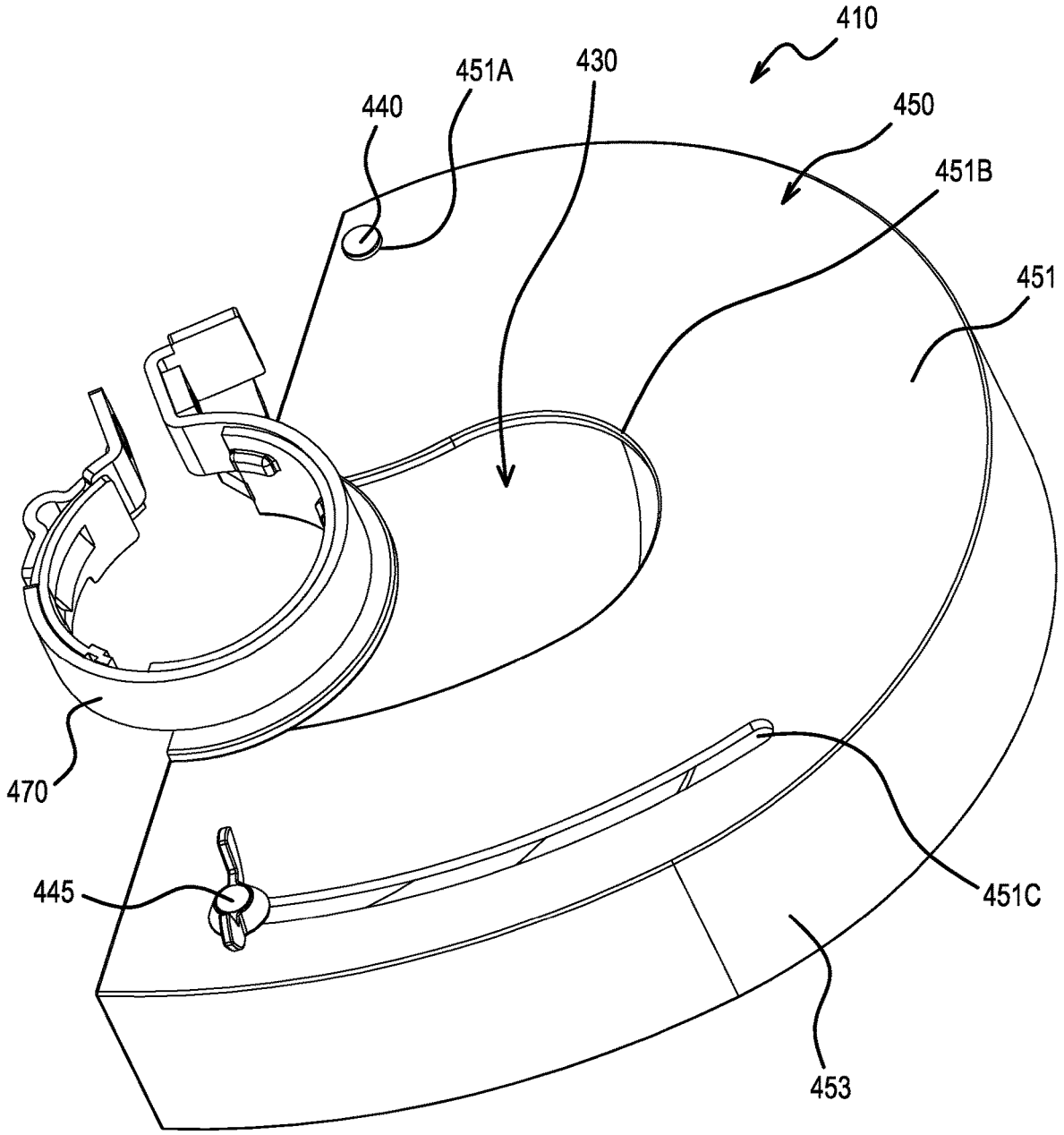
FIG. 20 is an oblique view that shows the first aspect of the protective cover according to the fourth embodiment.
Figure 21:
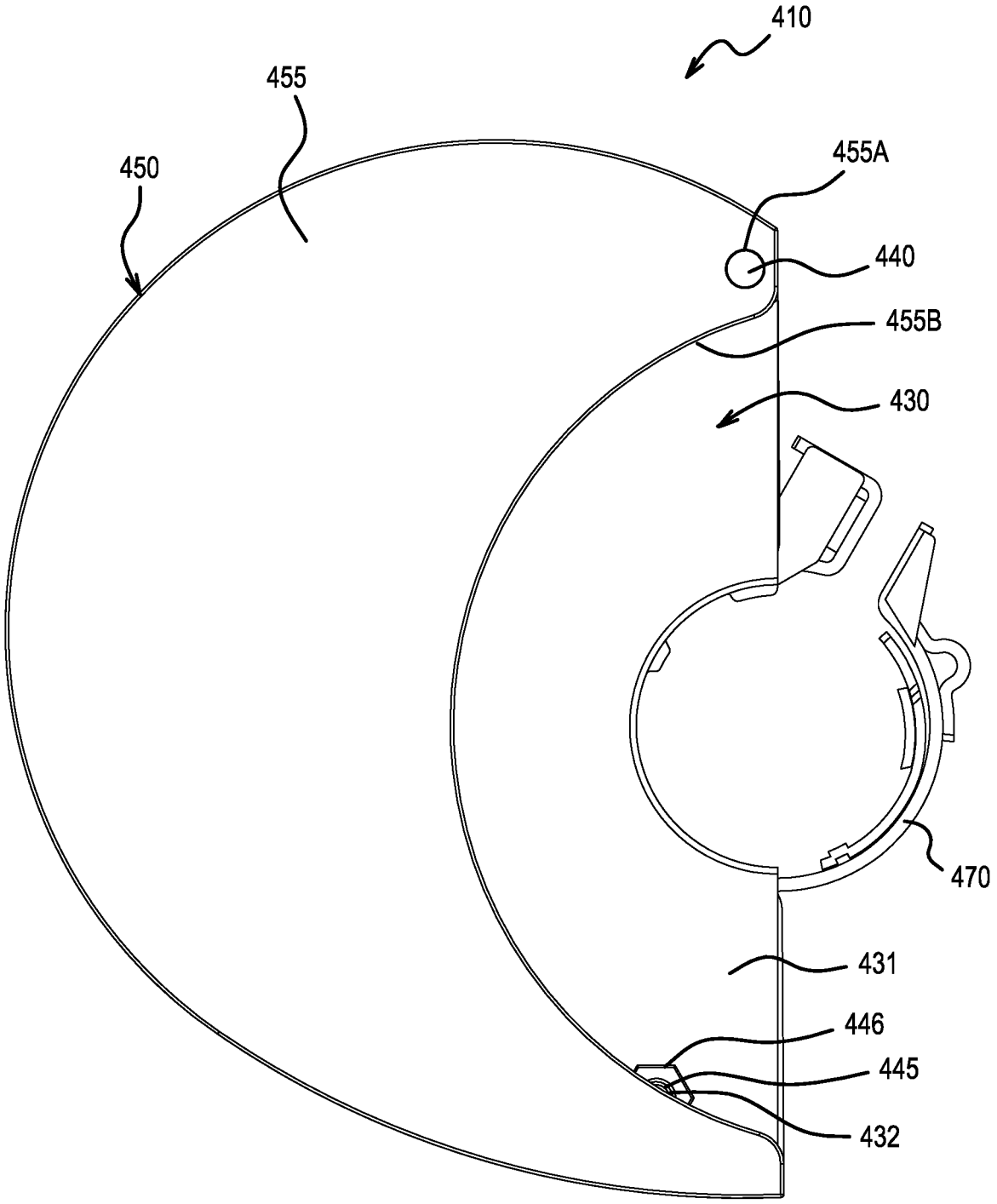
FIG. 21 is a bottom view that shows the first aspect of the protective cover according to the fourth embodiment.

The lower-part structure 455 is configured such that it is located below the upper-part structure 451 and is capable of covering the area below the tool accessory 40 not covered by the main-cover part 430. The lower-part structure 455 has an opening 455B and is configured such that the outer-side-cover part 450 is pivoted maximally rearward in the state in which the screw 445 is loosely screwed into the nut 446 and such that the area below the tool accessory 40 not covered by the main-cover part 430 is mostly not covered in the state in which the outer-side-cover part 450 is disposed at the first position, as shown in FIG. 19, FIG. 20, and FIG. 21.

In the process of maximally pivoting forward with respect to the main-cover part 430, the outer-side-cover part 450 undergoes relative movement with respect to the main-cover part 430 such that the area below the tool accessory 40 not covered by the main-cover part 430 becomes gradually covered by the lower-part structure 455, as shown in FIG. 22, FIG. 23, and FIG. 24.

Figure 25:
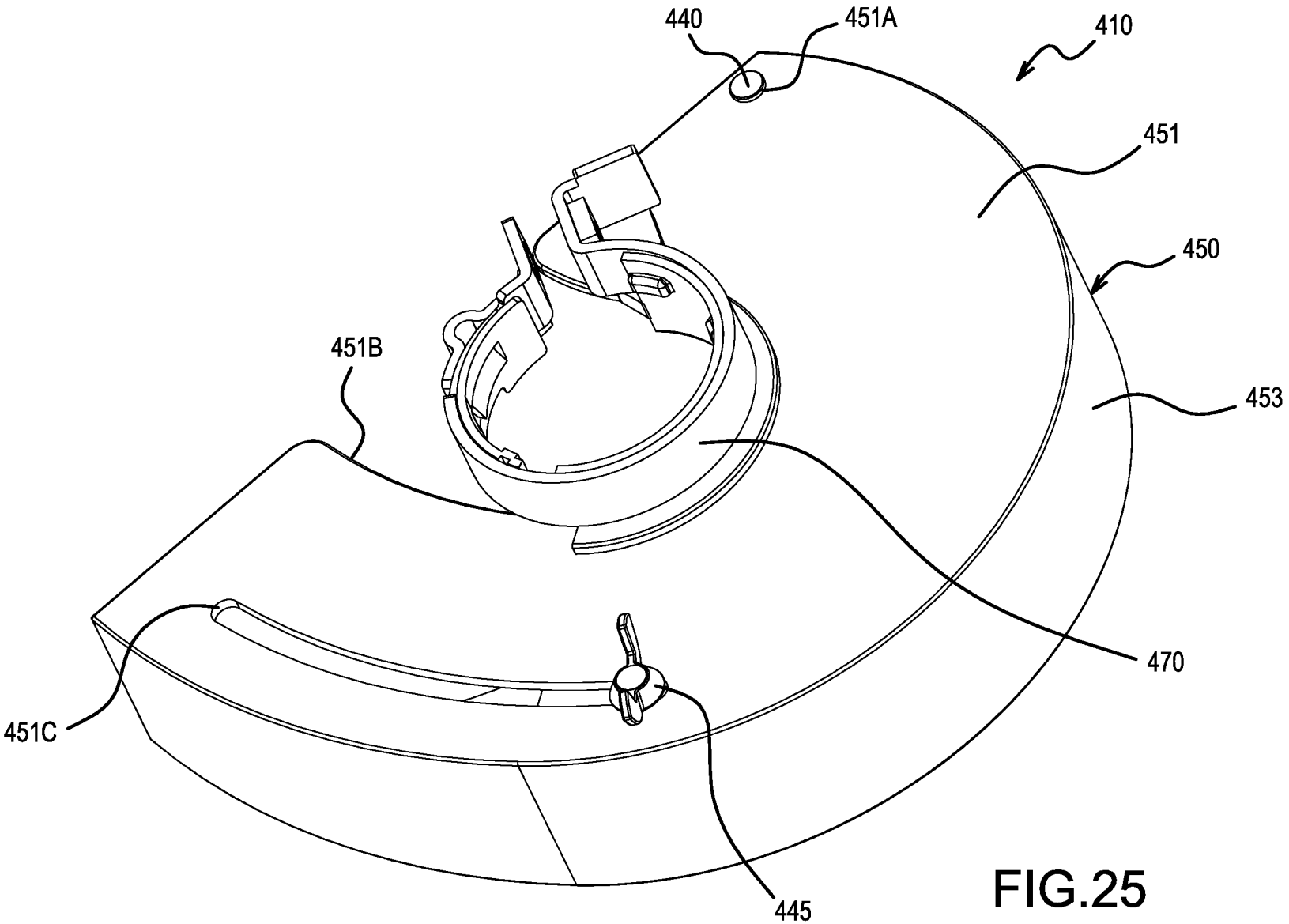
FIG. 25 is an oblique view that shows a third aspect of the protective cover according to the fourth embodiment.
Figure 26:
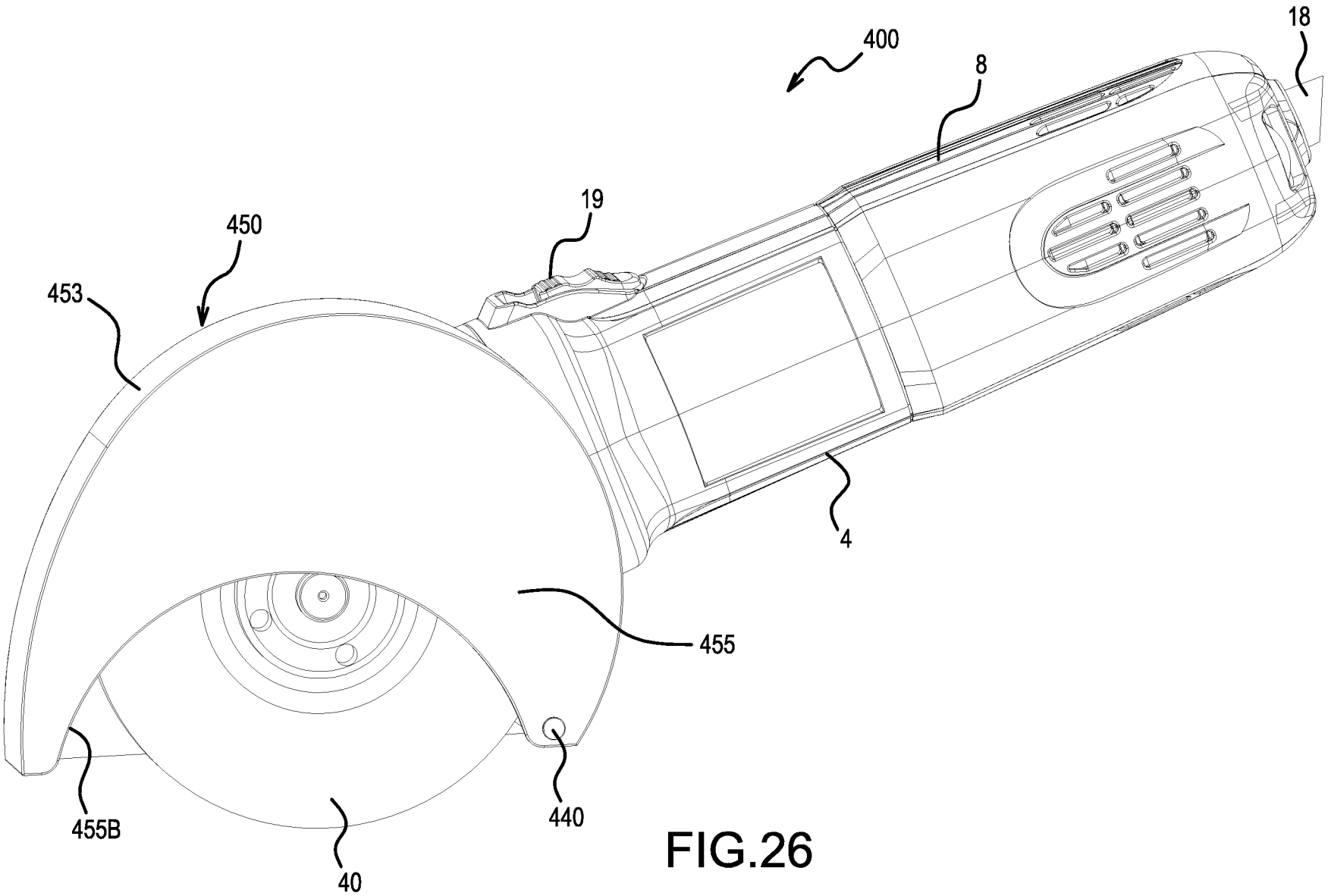
FIG. 26 is an oblique view that shows the third aspect of the grinder according to the fourth embodiment.

When the outer-side-cover part 450 is maximally pivoted forward with respect to the main-cover part 430 and thereby is disposed at the second position, the outer-side-cover part 450 is disposed such that, within the area below the tool accessory 40 not covered by the main-cover part 430, the area below the upper-part structure 431 is substantially entirely covered, as shown in FIG. 25 and FIG. 26.

According to the present embodiment, each of the cover parts 430, 450 that cover the tool accessory 40 is provided such that it is capable of relative movement along the surface of one of the cover parts. Specifically, the outer-side-cover part 450, which is the second cover part, is provided such that it is capable of pivoting with respect to the main-cover part 430, which is the first cover part, in the transverse direction around the axis of the pivot pin 440. The protective cover 410 is configured such that the area below the tool accessory 40 that is covered changes in accordance with the movement of the outer-side-cover part 450 in the transverse direction with respect to the main-cover part 430.

Similar to when the cover main body 351 is disposed at the first position in the third embodiment (refer to FIG. 15 and FIG. 16), the area below the tool accessory 40 is mostly not covered when the outer-side-cover part 450 is disposed at the first position with respect to the main-cover part 430, as shown in FIG. 19, FIG. 20, and FIG. 21. Accordingly, the protective cover 410 can be adapted to grinding work in which a grinding stone is used.

On the other hand, when the outer-side-cover part 450 is disposed at the second position with respect to the main-cover part 430, as shown in FIG. 25 and FIG. 26, the semicircular area of the tool accessory 40 is mostly covered. Accordingly, the protective cover 410 can be adapted to cutting work in which a cutting stone is used. In the grinder 400 shown in FIG. 26, the orientation of the circumferential direction of the protective cover 410 is adjusted to an orientation that is suited to the cutting work.

Accordingly, according to the present embodiment, the user can adjust the area over which the tool accessory 40 is covered from below in accordance with the type of the tool accessory 40 and the processing work. That is, according to the present embodiment, a highly convenient grinder can be provided.

Fifth Embodiment

The grinder 500 according to a fifth embodiment is configured such that a protective cover 510 shown in FIG. 27 to FIG. 30 is mounted on the grinder 1 shown in FIG. 1 or on a similar grinder.

The protective cover 510 comprises a main-cover part 530, an auxiliary-cover part 550, and a circular-tubular part 570, which is for fixing the main-cover part 530 to the second gear housing 30. The auxiliary-cover part 550 is disposed below the main-cover part 530 and has a foldable structure. The protective cover 510 is configured such that the area over which the tool accessory 40 is covered from below changes in accordance with whether the auxiliary-cover part 550 is in a folded state.

Figure 29:
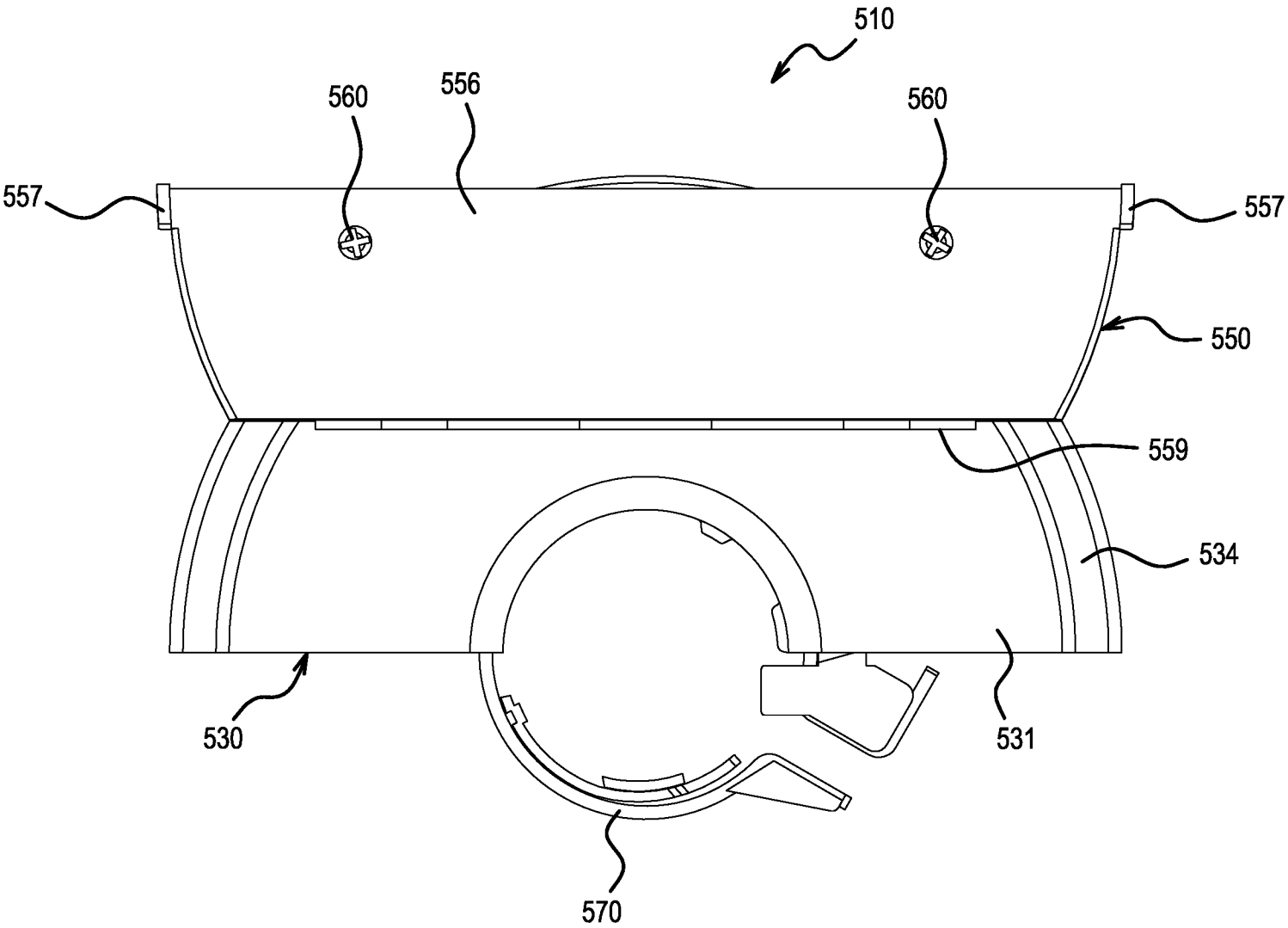
FIG. 29 is a bottom view that shows a second aspect of the protective cover according to the fifth embodiment.

Similar to the protective cover 60, the main-cover part 530 comprises a semicircular upper-part structure 531, which is for covering the rearward semicircular portion of the upper part of the tool accessory 40, and a side-part structure 533, which extends downward from an outer-circumferential-end edge of the upper-part structure 531, and is configured such that it covers the tool accessory 40 from above and the side. The upper-part structure 531 and the side-part structure 533 are integrally formed of, for example, a metal material. As shown in FIG. 29, the side-part structure 533 comprises, at its lower end, a curved part 534 that curves toward the inner side in the radial direction.

The auxiliary-cover part 550 comprises: a side-part structure 551, which extends along an outer-circumferential surface of the side-part structure 533 of the main-cover part 530; and a first lower-part structure 554 and a second lower-part structure 556, which cover a semicircular area below the tool accessory 40 that is enclosed by the side-part structure 551, in other words, the area below the upper-part structure 531. The side-part structure 551, the first lower-part structure 554, and the second lower-part structure 556 are composed of, for example, a metal material.

The side-part structure 551 is brought into pressure-contact with the main-cover part 530 by fitting the side-part structure 551 onto the side-part structure 533 of the main-cover part 530, and thereby the auxiliary-cover part 550 is detachably fixed to the main-cover part 530. Alternatively, the auxiliary-cover part 550 is undetachably fixed to the main-cover part 530 by welding.

The first lower-part structure 554 is joined to a lower end of the side-part structure 551 at a position that is farther from the center of an arc along the outer circumference of the side-part structure 551 than is the second lower-part structure 556. The second lower-part structure 556 is connected to the first lower-part structure 554 such that it can pivot via a hinge 559. The hinge 559 connects the second lower-part structure 556 to the first lower-part structure 554 such that the second lower-part structure 556 can pivot around an axis along a plane perpendicular to the up-down direction.

Figure 27:
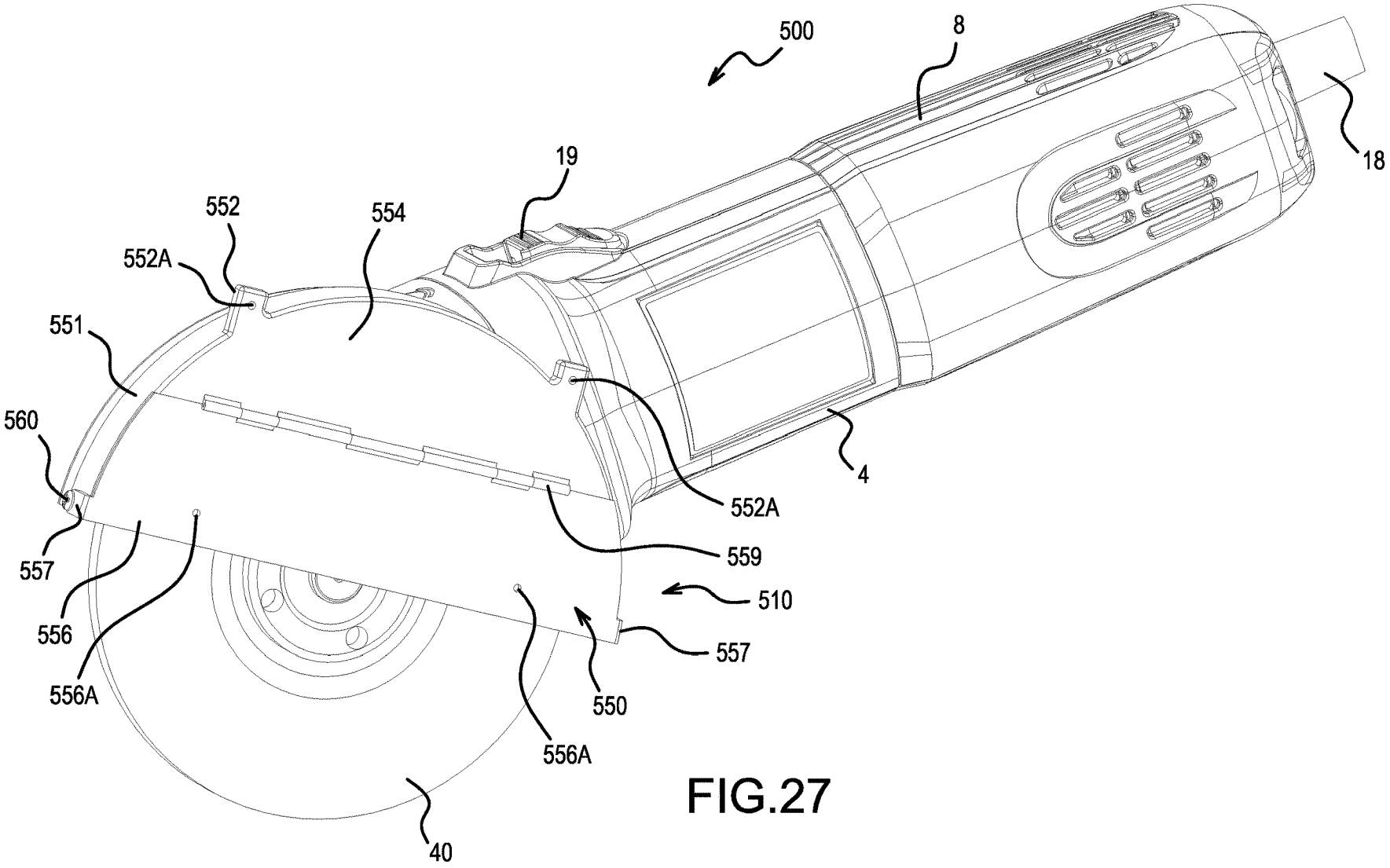
FIG. 27 is an oblique view that shows a first aspect of the grinder according to a fifth embodiment.
Figure 28:
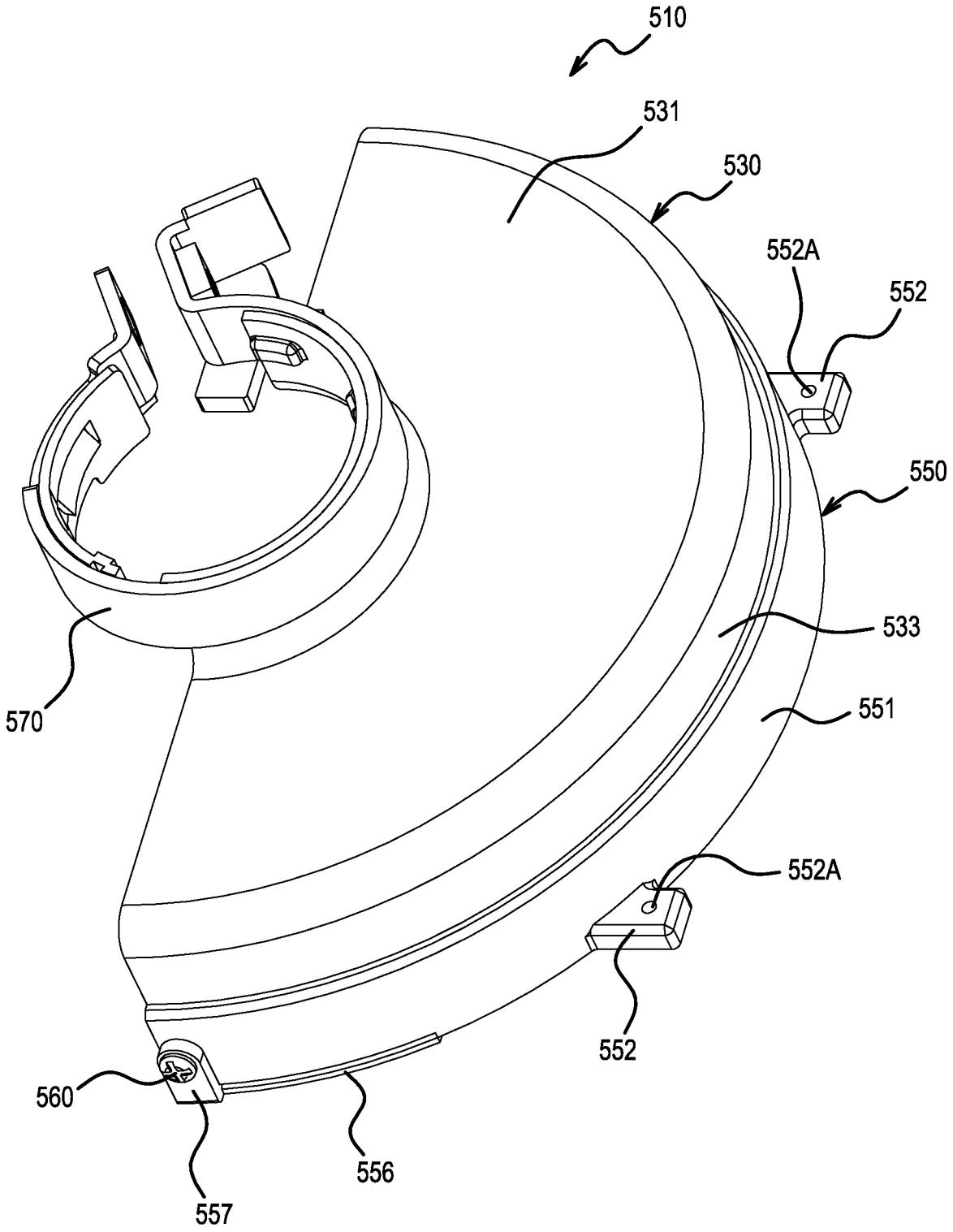
FIG. 28 is an oblique view that shows the first aspect of the protective cover according to the fifth embodiment.

Owing to this connection, when the second lower-part structure 556 is not folded with respect to the first lower-part structure 554, as shown in FIG. 27 and FIG. 28, the second lower-part structure 556 covers, within the area below the upper-part structure 531, the area not covered by the first lower-part structure 554.

Figure 30:
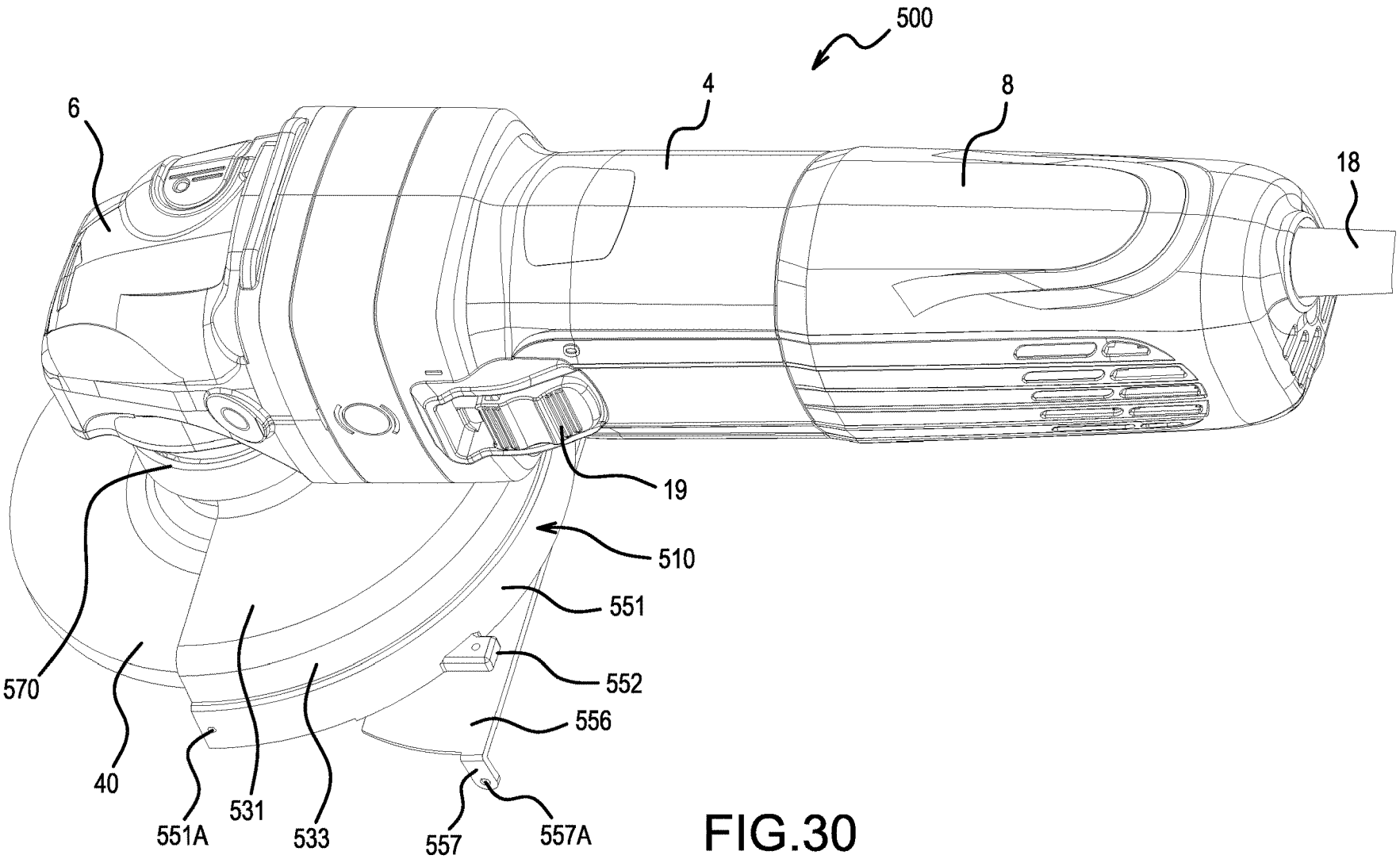
FIG. 30 is an oblique view that shows the second aspect of the grinder according to the fifth embodiment.

The area below the tool accessory 40 covered by the second lower-part structure 556 is not covered and is externally exposed when the second lower-part structure 556 is folded with respect to the first lower-part structure 554, as shown in FIG. 29 and FIG. 30.

The auxiliary-cover part 550 further comprises a structure for fixing the pivotable second lower-part structure 556. The side-part structure 551 of the auxiliary-cover part 550 comprises two fixing parts 552 that have screw holes 552A, which communicate with through holes 556A, provided at two locations of the second lower-part structure 556, when the second lower-part structure 556 is folded to the first lower-part structure 554 side. As shown in FIG. 29, when the second lower-part structure 556 is folded to the first lower-part structure 554 side, the second lower-part structure 556 is fixed to the fixing parts 552 by screws 560 that screw into the screw holes 552A through the through holes 556A, and thereby the folded state is maintained.

In addition, the auxiliary-cover part 550 comprises fixing parts 557, which are provided such that they extend vertically from left and right end parts of the second lower-part structure 556 and have through holes 557A. The auxiliary-cover part 550 has, in forward left- and right-end-parts of the side-part structure 551, as shown in FIG. 30, screw holes 551A that communicate with the through holes 557A, which constitute the fixing part 557, when the second lower-part structure 556 is not folded with respect to the first lower-part structure 554.

The screws 560 (refer to FIG. 29) described above, which are used for holding the second lower-part structure 556 in the folded state, are screwed into the screw holes 551A, which are provided in the left and right end parts of the side-part structure 551, through the through holes 557A in the state in which the second lower-part structure 556 is not folded with respect to the first lower-part structure 554. Thereby, the second lower-part structure 556 is screw-fastened to the side-part structure 551, as shown in FIG. 27 and FIG. 28, when the second lower-part structure 556 is not folded with respect to the first lower-part structure 554, and that state is maintained.

According to the present embodiment, the auxiliary-cover part 550, which covers the tool accessory 40 from below, has a structure that includes the first lower-part structure 554 and the second lower-part structure 556 and that is foldable. Owing to this structure, the protective cover 510 is configured such that the area over which the tool accessory 40 is covered from below is changeable. In the folded state, the auxiliary-cover part 550 covers the rearward portion of the area below the tool accessory 40 not covered by the main-cover part 530; in the unfolded state, the auxiliary-cover part 550 further covers the area located forward of the rearward area.

Accordingly, according to the present embodiment, as in the fourth embodiment, the area over which the tool accessory 40 is covered from below can be adjusted in accordance with the type of the tool accessory 40 and the processing work, even if multiple types of the tool accessory 40, such as cutting stones and grinding stones, are used, by being switched in and out. Thus, a highly convenient grinder can be provided.

According to the present embodiment, the screws 560 are used for fixing the second lower-part structure 556 both in the state in which the second lower-part structure 556 is folded and in the state in which the second lower-part structure 556 is not folded. Accordingly, it is possible to reduce the possibility that the user will lose the screws 560.

As in the second embodiment, the auxiliary-cover part 550 described above may be composed of a transparent member or a mesh member such that the user's view is not obstructed when the auxiliary-cover part 550 is interposed between the user and the portion of the workpiece to be processed. According to this configuration, work efficiency is improved.

Other Embodiments

The first embodiment to the fifth embodiment are explained above, but the grinder and the cover of the present disclosure are not limited to the above-mentioned embodiments, and various other embodiments can be adopted.

A function possessed by one structural element in the above-mentioned embodiments may be provided such that it is distributed among multiple structural elements. A function possessed by multiple structural elements may be integrated in one structural element. Some of the structural elements in the above-mentioned embodiments may be omitted. At least some of the structural elements in the above-mentioned embodiments may be added to or replaced by structural elements of other embodiments mentioned above. Any aspect that is included in the technical concepts specified based on the text of the claims is an embodiment of the present invention.

Additional representative, non-limiting embodiments of the present teachings include:

1. A grinder comprising: a motor; a housing that houses the motor; a spindle that protrudes downward from the housing, is driven by the motor, and thereby rotates; and a cover that at least partially covers a tool accessory, which is mounted on the spindle, wherein the cover comprises: a first cover part that is provided in a circumferential direction of the spindle, is fixed to the housing, and at least partially covers the tool accessory from above; and a second cover part that is held by the first cover part such that the second cover part is capable of relative movement with respect to the first cover part; and an area of the tool accessory covered by the cover changes in accordance with the relative movement of the second cover part with respect to the first cover part.

2. A grinder comprising: a motor; a housing that houses the motor; a spindle that protrudes downward from the housing, is driven by the motor, and thereby rotates; and a cover that at least partially covers a tool accessory, which is mounted on the spindle; wherein the cover comprises: a first cover part that is provided in a circumferential direction of the spindle, is fixed to the housing, and at least partially covers the tool accessory from above; and a second cover part that is held by the first cover part such that the second cover part is capable of relative movement along a circumferential direction of the spindle with respect to the first cover part; and an area of the tool accessory covered by the cover changes in accordance with the relative movement of the second cover part along the circumferential direction with respect to the first cover part.

3. The grinder according to the above-described embodiment 2, wherein the first cover part is configured such that, in a specific angular area in the circumferential direction, the tool accessory is partially covered from below; and the second cover part undergoes relative movement with respect to the first cover part along the circumferential direction from the specific angular area to a separate angular area in which the tool accessory is not covered from below by the first cover part, and thereby the area below the tool accessory that is not covered by the first cover part is at least partially covered.

4. A grinder comprising: a motor; a housing that houses the motor; a spindle that protrudes downward from the housing, is driven by the motor, and thereby rotates; and a cover that at least partially covers a tool accessory, which is mounted on the spindle; wherein the cover comprises: a first cover part that is provided in a circumferential direction of the spindle, is fixed to the housing, and at least partially covers the tool accessory from above; and a second cover part that is held by the first cover part such that the second cover part is capable of pivoting around a specific axis that is nonparallel to an axial direction of the spindle; and an area of the tool accessory covered by the cover changes in accordance with the pivoting of the second cover part around the specific axis with respect to the first cover part.

5. The grinder according to the above-described embodiment 4, wherein the second cover part is held by the first cover part such that the second cover part is capable of pivoting around, as the prescribed axis, a prescribed axis along a plane that is perpendicular to the axial direction of the spindle; and the second cover part is disposed at differing first and second positions, owing to the pivoting, with respect to the first cover part, wherein, at the first position, the area below the tool accessory not covered by the first cover part is at least partially covered, and, at the second position, the area above the tool accessory not covered by the first cover part is at least partially covered.

6. The grinder according to the above-described embodiment 5, wherein the second cover part is at least partially composed of a transparent material or a mesh material.

7. A grinder comprising: a motor; a housing that houses the motor; a spindle that protrudes downward from the housing, is driven by the motor, and thereby rotates; and a cover that at least partially covers a tool accessory, which is mounted on the spindle; wherein the cover comprises: a first cover part that is provided in a circumferential direction of the spindle, is fixed to the housing, and at least partially covers the tool accessory from above; and a second cover part that is held by the first cover part such that the second cover part is capable of relative movement along an axial direction of the spindle with respect to the first cover part; and an area of the tool accessory covered by the cover changes in accordance with change in the position of the second cover part with respect to the first cover part owing to the relative movement.

8. The grinder according to the above-described embodiment 7, wherein the second cover part is disposed, owing to the relative movement, at differing first and second positions with respect to the first cover part, wherein, at the first position, the second cover part forms a space, which houses the tool accessory between the second cover part and the inner surface of the first cover part that faces the tool accessory, and at least partially covers the tool accessory from below, and, at the second position, the second cover part approaches the inner surface of the first cover part and, together with the first cover part, at least partially covers the tool accessory from above.

9. A grinder comprising: a motor; a housing that houses the motor; a spindle that protrudes downward from the housing, is driven by the motor, and thereby rotates; and a cover that at least partially covers a tool accessory, which is mounted on the spindle; wherein the cover comprises: a first cover part that is provided in a circumferential direction of the spindle, is fixed to the housing, has a surface that at least partially covers the tool accessory from above, and extends along the surface; and a second cover part that is held by the first cover part such that the second cover part is capable of relative movement along the surface with respect to the first cover part; and an area of the tool accessory covered by the cover changes in accordance with the relative movement of the second cover part along the surface with respect to the first cover part.

10. The grinder according to the above-described embodiment 9, wherein the second cover part is configured such that it at least partially covers the tool accessory from below; and an area below the tool accessory covered by the cover changes in accordance with the relative movement of the second cover part with respect to the first cover part along the surface.

11. A grinder comprising: a motor; a housing that houses the motor; a spindle that protrudes downward from the housing, is driven by the motor, and thereby rotates; and a cover that at least partially covers a tool accessory, which is mounted on the spindle; wherein the cover comprises: a first cover part that is provided in a circumferential direction of the spindle, is fixed to the housing, and at least partially covers the tool accessory from above; and a second cover part that is held by the first cover part and has a foldable structure; and an area of the tool accessory covered by the cover changes in accordance with whether the second cover part is in the folded state.

12. The grinder according to the above-described embodiment 11, wherein in the folded state, the second cover part covers a first area below the tool accessory that is not covered by the first cover part and, in the unfolded state, the second cover part covers, in addition to the first area, a second area below the tool accessory that is not covered by the first cover part.

13. A cover that at least partially covers a tool accessory mounted on a spindle, which constitutes a grinder and protrudes downward from a housing, comprising: a first cover part that is provided in a circumferential direction of the spindle, is fixed to the housing, and at least partially covers the tool accessory from above; and a second cover part that is held by the first cover part such that the second cover part is capable of relative movement with respect to the first cover part; wherein an area of the tool accessory covered by the cover changes in accordance with relative movement of the second cover part with respect to the first cover part.

14. A cover that at least partially covers a tool accessory mounted on a spindle, which constitutes a grinder and protrudes downward from a housing, comprising: a first cover part that is provided in a circumferential direction of the spindle, is fixed to the housing, and at least partially covers the tool accessory from above; and a second cover part that is held by the first cover part such that the second cover part is capable of relative movement with respect to the first cover part along a circumferential direction of the spindle; wherein an area of the tool accessory covered by the cover changes in accordance with relative movement of the second cover part with respect to the first cover part along the circumferential direction.

15. The cover according to the above-described embodiment 14, wherein the first cover part is configured such that, in a specific angular area in the circumferential direction, the tool accessory is partially covered from below; and the second cover part undergoes relative movement with respect to the first cover part along the circumferential direction from the specific angular area to a separate angular area in which the tool accessory is not covered from below by the first cover part, and thereby the area below the tool accessory that is not covered by the first cover part is at least partially covered.

16. A cover that at least partially covers a tool accessory mounted on a spindle, which constitutes a grinder and protrudes downward from a housing, comprising: a first cover part that is provided in a circumferential direction of the spindle, is fixed to the housing, and at least partially covers the tool accessory from above; and a second cover part that is held by the first cover part such that the second cover part is capable of pivoting around the specific axis with respect to the first cover part; wherein an area of the tool accessory covered by the cover changes in accordance with relative movement of the second cover part with respect to the first cover part.

17. The cover according to the above-described embodiment 16, wherein the second cover part is held by the first cover part such that the second cover part is capable of pivoting around, as the prescribed axis, a prescribed axis along a plane that is perpendicular to the axial direction of the spindle; and the second cover part is disposed at differing first and second positions, owing to the pivoting, with respect to the first cover part, wherein, at the first position, the area below the tool accessory not covered by the first cover part is at least partially covered, and, at the second position, the area above the tool accessory not covered by the first cover part is at least partially covered.

18. A cover that at least partially covers a tool accessory mounted on a spindle, which constitutes a grinder and protrudes downward from a housing, comprising: a first cover part that is provided in a circumferential direction of the spindle, is fixed to the housing, and at least partially covers the tool accessory from above; and a second cover part that is held by the first cover part such that the second cover part is capable of relative movement with respect to the first cover part along an axial direction of the spindle; wherein an area of the tool accessory covered by the cover changes in accordance with change in the position of the second cover part with respect to the first cover part owing to the relative movement.

19. The cover according to the above-described embodiment 18, wherein the second cover part is disposed, owing to the relative movement, at differing first and second positions with respect to the first cover part, wherein, at the first position, the second cover part forms a space, which houses the tool accessory between the second cover part and the inner surface of the first cover part that faces the tool accessory, and at least partially covers the tool accessory from below, and, at the second position, the second cover part approaches the inner surface of the first cover part and, together with the first cover part, at least partially covers the tool accessory from above.

20. A cover that at least partially covers a tool accessory mounted on a spindle, which constitutes a grinder and protrudes downward from a housing, comprising: a first cover part that is provided in a circumferential direction of the spindle, is fixed to the housing, has a surface that at least partially covers the tool accessory from above, and extends along the surface; and a second cover part that is held by the first cover part such that the second cover part is capable of relative movement along the surface with respect to the first cover part; wherein an area of the tool accessory covered by the cover changes in accordance with relative movement of the second cover part along the surface with respect to the first cover part.

21. The cover according to the above-described embodiment 20, wherein the second cover part is configured such that it at least partially covers the tool accessory from below; and an area below the tool accessory covered by the cover changes in accordance with the relative movement of the second cover part with respect to the first cover part along the surface.

22. A cover that at least partially covers a tool accessory mounted on a spindle, which constitutes a grinder and protrudes downward from a housing, comprising: a first cover part that is provided in a circumferential direction of the spindle, is fixed to the housing, and at least partially covers the tool accessory from above; and a second cover part that is held by the first cover part and has a foldable structure; wherein an area of the tool accessory covered by the cover changes in accordance with whether the second cover part is in a folded state.

23. The cover according to the above-described embodiment 22, wherein in the folded state, the second cover part covers a first area below the tool accessory that is not covered by the first cover part and, in the unfolded state, the second cover part covers, in addition to the first area, a second area below the tool accessory that is not covered by the first cover part.

24. A method of using a grinder comprising: attaching a cover to a grinder housing, the cover being configured to at least partially cover a tool accessory mounted on a spindle of the grinder which spindle protrudes downward from the housing, wherein the cover comprises a movable part and changes shape such that an area of the tool accessory covered by the cover changes in accordance with an operation of the movable part; and if the tool accessory comprises a grinding wheel for grinding, then operating the movable part to set the cover to a first shape, and, if the tool accessory comprises a grinding wheel for cutting, then operating the movable part to set the cover to a second shape; wherein the cover covers an area below the tool accessory that is larger for the second shape than for the first shape.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved grinders and grinder covers.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

EXPLANATION OF THE REFERENCE NUMBERS

1 Grinder
4 Motor housing
6 First gear housing
8 Rear cover
12 Motor
14 Rotary shaft
20 First bevel gear
22 Second bevel gear
24 Spindle
25 Screw part
26 Bearing
28 Bearing
30 Second gear housing
31 Cover-connection part
32 Inner flange
34 Lock nut
40 Tool accessory
60 Protective cover
61 Upper-part structure
63 Side-part structure
64 Curved part
67 Circular-tubular part
100 Grinder
110 Protective cover
130 Main-cover part
131 Upper-part structure
131A Extended portion
132 Guide projection
133 Side-part structure
134 Curved part
135 Lower-part structure
140 Outer-side-cover part
141 Upper-part structure
142 Elongate recess
143 Side-part structure
145 Lower-part structure
150 Inner-side cover part
151 Upper-part structure
152 Elongate recess
153 Side-part structure
155 Lower-part structure
170 Circular-tubular part
175 Tightening part
200 Grinder
210 Protective cover
230 Main-cover part
231 Upper-part structure
233 Side-part structure
234 Curved part
235 Lower-part structure
250 Auxiliary-cover part
251 Cover main body
253 Arm
254 Through hole
256 Through hole
257 Through hole
260 Pivot pin
265 Screw
270 Circular-tubular part
300 Grinder
310 Protective cover
330 Main-cover part
331 Upper-part structure
333 Side-part structure
334 Curved part
335 Screw-housing part
336 Circlip
337 Screw
350 Auxiliary-cover part
351 Cover main body
353 Nut
370 Circular-tubular part
400 Grinder
410 Protective cover
430 Main-cover part
431 Upper-part structure
432 Insertion hole
433 Side-part structure
434 Curved part
436 Pin-housing part
440 Pivot pin
445 Screw
446 Nut
450 Outer-side-cover part
451 Upper-part structure
451A Upper-part through hole
451B Opening
451C Slit
453 Side-part structure
455 Lower-part structure
455A Lower-part through hole
455B Opening
470 Circular-tubular part
500 Grinder
510 Protective cover
530 Main-cover part
531 Upper-part structure
533 Side-part structure
534 Curved part
550 Auxiliary-cover part
551 Side-part structure
551A Screw hole
552 Fixing part
552A Screw hole
554 First lower-part structure
556 Second lower-part structure
556A Through hole
557 Fixing part
557A Through hole
559 Hinge
560 Screw
570 Circular-tubular part

The invention claimed is:

1. A cover configured to at least partially cover a tool accessory mounted on a spindle of a grinder, the spindle protruding downward from a housing, the cover comprising:

a first cover part that is provided in a circumferential direction of the spindle, is fixed to the housing, and is configured to at least partially cover the tool accessory from above;

and a second cover part that is held by the first cover part such that the second cover part is movable relative to the first cover part;

wherein:

an area of the tool accessory covered by the cover changes in accordance with movement of the second cover part relative to the first cover part;

the second cover part is pivotable with respect to the first cover part around a specific axis that is nonparallel to an axial direction of the spindle;

the specific axis lies along a plane that is perpendicular to the axial direction of the spindle, the first cover part includes an upper-part structure that extends across a first portion of an area directly above the tool accessory; and a lower-part structure that extends across a second portion of an area directly below the tool accessory; and the upper-part structure includes:

a first part that overlaps the lower-part structure; and a second part that does not overlap the lower-part structure;

the second cover part is pivotable between a first position and a second position with respect to the first cover part, wherein, at the first position, a portion of the area directly below the tool accessory not covered by the first cover part is at least partially covered by the second cover part, and, at the second position, a portion of the area directly above the tool accessory not covered by the first cover part is at least partially covered by the second cover part; and the second cover part, at the first position, extends directly below the tool accessory and directly below the second part of the upper-part structure, and covers substantially an entirety of the second part from below when the spindle is located below the housing.

2. The cover according to claim 1, wherein:

the tool accessory has a circular periphery located on a surface of an imaginary cylinder; and the area directly below the tool accessory is located inside the imaginary cylinder.

3. A cover configured to at least partially cover a tool accessory mounted on a spindle of a grinder, the spindle protruding downward from a housing of the grinder, the cover comprising:

a first cover part that is provided in a circumferential direction of the spindle and is fixed to the housing; and a second cover part that is held by the first cover part such that the second cover part is movable relative to the first cover part;

wherein:

the second cover part is pivotable with respect to the first cover part around a specific axis that lies along a plane perpendicular to an axial direction of the spindle between a first position below the tool accessory and a second position above the tool accessory;

the first cover part extends above and across a first portion of a top surface of the tool accessory;

at the first position, the second cover part extends across a portion of the bottom surface of the tool accessory not covered by the first cover part; and at the second position, the second cover part extends across a portion of the top surface of the tool accessory not covered by the first cover part, the first cover part includes:

an upper-part structure that extends above and across the first portion of the tool accessory; and a lower-part structure that extends below and across a second portion of the tool accessory;

the upper-part structure includes:

a first part that overlaps the lower-part structure; and a second part that does not overlap the lower-part structure; and the second cover part, at the second position, extends above and across a part of the tool accessory adjacent to the first portion of the tool accessory, the second cover part, at the first position, extends directly below the tool accessory and directly below the second part of the upper-part structure, and the second cover part covers substantially an entirety of the second part from below when the spindle is located below the housing.

4. A grinder comprising:

a motor;

a housing that houses the motor;

a spindle that protrudes downward from the housing, is driven by the motor, and thereby rotates; and the cover according to claim 3.

5. The grinder according to claim 4, wherein the second cover part is at least partially composed of a transparent material or a mesh material.

6. The cover according to claim 3, wherein:

the pivoting of the second cover part with respect to the first cover part is limited by contact of the second cover part with the lower-part structure of the first cover part, and the second cover part in the first position contacts the lower-part structure.

7. The cover according to claim 3, wherein:

the first cover part extends below and across a portion of the bottom surface of the tool accessory that is not covered by the second cover part in the first position.

8. The cover according to claim 3, wherein:

the second cover part in the first position forms an extension of the lower-part structure; and the second cover part in the second position forms an extension of the upper-part structure.

9. The cover according to claim 3, wherein:

the tool accessory has a circular periphery located on a surface of an imaginary cylinder; and the second cover part is located at least partly inside the imaginary cylinder in the first position and in the second position.

10. A cover system for a grinder, comprising:

a main-cover part configured to be detachably attached to the grinder, the grinder including a spindle protruding downward from a housing of the grinder and having a vertical axis;

an auxiliary-cover part rotatably attached to the main-cover part; and a first pivot pin and a second pivot pin that define a cover rotation axis;

wherein:

the auxiliary-cover part is configured to rotate about the first and second pivot pins between an upper position and a lower position;

the main-cover part includes:

a semicircular upper-part structure extending horizontally;

a side-part structure that extends downward from the semicircular upper-part structure; and a lower-part structure that extends horizontally from a lower portion of the side-part structure; and the cover rotation axis is horizontal, is located between the semicircular upper-part structure and the lower-part structure, and intersects the spindle of the grinder, the semi-circular upper-part structure includes a first area and a second area, the lower-part structure underlies the first area, the lower-part structure does not underlie the second area, and the auxiliary-cover part is configured to, in the lower position, cover substantially an entirety of the second area from below when the spindle is located below the housing.

11. The cover system according to claim 10, wherein the cover rotation axis is located at least substantially midway between the semicircular upper-part structure and the lower-part structure.

12. The cover system according to claim 11, wherein the auxiliary-cover part includes:

a cover main body; and a first arm and a second arm that are located at respective opposite sides of the cover main body and extend substantially vertically.

13. The cover system according to claim 12, wherein:

the first arm is configured to pivot on the first pivot pin, and the second arm is configured to pivot on the second pivot pin.

14. The cover system according to claim 13, wherein the first arm and the second arm are located outside the side-part structure.

15. The cover system according to claim 13, wherein the first arm includes a first through hole configured to receive a fastener that locks the first arm to the side-part structure such that the auxiliary-cover part is locked in the upper position.

16. The cover system according to claim 13, wherein the auxiliary-cover part located in the upper position is substantially coplanar with the semicircular upper-part structure of the main-cover part.

17. The cover system according to claim 13, wherein the auxiliary-cover part located in the lower position is substantially coplanar with the lower-part structure of the main-cover part.

18. The cover system according to claim 10, wherein the second area is larger than the first area.

19. The cover system according to claim 10, wherein the auxiliary-cover part is configured to, in the lower position, underlap an edge of the lower-part structure.

20. The cover system according to claim 13, wherein:

the first arm includes a first hole and a second hole; and the first hole is configured to receive a fastener therein to fix the auxiliary-cover part in the upper position; and the second hole is configured to receive the fastener therein to fix the auxiliary-cover part in the lower position.

21. The cover system according to claim 20, wherein the fastener includes a screw with wings configured to be manually manipulated.

* * * * *